US010485278B2

(12) United States Patent
Noll et al.

(10) Patent No.: US 10,485,278 B2
(45) Date of Patent: Nov. 26, 2019

(54) DUAL-JACKET ASSEMBLY

(71) Applicant: NIKE, Inc., Beaverton, OR (US)

(72) Inventors: Eric R. Noll, Portland, OR (US); Robert O. Darmour, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 24 days.

(21) Appl. No.: 15/366,265

(22) Filed: Dec. 1, 2016

(65) Prior Publication Data

US 2017/0156419 A1 Jun. 8, 2017

Related U.S. Application Data

(60) Provisional application No. 62/262,789, filed on Dec. 3, 2015.

(51) Int. Cl.
*A41D 15/00* (2006.01)
*A41D 3/00* (2006.01)
(Continued)

(52) U.S. Cl.
CPC ..... *A41D 15/00* (2013.01); *A41D 3/00* (2013.01); *A41D 3/02* (2013.01); *A41D 27/04* (2013.01);
(Continued)

(58) Field of Classification Search
CPC ..... A41D 15/00; A41D 15/07; A41D 15/007; A41D 3/00; A41D 3/02; A41D 3/04; A41D 2400/422
(Continued)

(56) References Cited

U.S. PATENT DOCUMENTS 4,217,663 A * 8/1980 Goldberg ..... A41D 3/00 2/102
4,792,040 A 12/1988 Wagstaff, III
(Continued)

FOREIGN PATENT DOCUMENTS

FR 2557435 A1 7/1985
FR 2719454 * 11/1995
(Continued)

OTHER PUBLICATIONS

International Preliminary Report on Patentability dated Jun. 14, 2018 in International Patent Application No. PCT/US2016/064659, 9 pages.
(Continued)

*Primary Examiner* — Alissa J Tompkins
*Assistant Examiner* — Brieanna Szafran
(74) *Attorney, Agent, or Firm* — Shook, Hardy & Bacon, LLP

(57) ABSTRACT

A dual-jacket assembly comprising an inner jacket coupled to an outer jacket by a cable system is provided herein. The outer jacket is configured at least to be worn over the inner jacket and to be stowed in a pocket of the inner jacket when not in use. The cable system comprises a plurality of cables, each coupled to the inner jacket at one end and coupled to the outer jacket at the other end. The plurality of cables is configured to position the outer jacket for easier donning and to be used by a wearer to stow the outer jacket in the pocket of the inner jacket when not in use.

20 Claims, 18 Drawing Sheets

(51) Int. Cl.

| | |
|---|---|
| ***A41D 27/20*** | (2006.01) |
| ***A41D 27/04*** | (2006.01) |
| ***A41D 3/02*** | (2006.01) |

(52) U.S. Cl.
CPC ..... *A41D 27/20* (2013.01); *A41D 2400/42* (2013.01); *A41D 2400/422* (2013.01)

(58) Field of Classification Search
USPC ..... 2/108, 93, 97
See application file for complete search history.

(56) References Cited

U.S. PATENT DOCUMENTS

| | | | | |
|---|---|---|---|---|
| 5,040,243 | A * | 8/1991 | Tatsuno | A41D 3/00 2/108 |
| 5,077,838 | A | 1/1992 | Senser | |
| 5,452,476 | A | 9/1995 | Jenks | |
| 5,564,125 | A | 10/1996 | Waldman et al. | |
| 5,860,164 | A | 1/1999 | Johnson | |
| 6,108,815 | A | 8/2000 | Majerfeld | |
| 6,385,775 | B1 | 5/2002 | Komjati | |
| 6,405,377 | B1 | 6/2002 | Davis | |
| 7,000,255 | B1 | 2/2006 | Baacke | |
| 7,374,071 | B2 | 5/2008 | Lavelle | |
| 7,770,234 | B2 | 8/2010 | Roux et al. | |
| 8,522,369 | B2 | 9/2013 | Bay | |
| 2004/0055069 | A1 | 3/2004 | Fayle et al. | |
| 2007/0083983 | A1 | 4/2007 | Barclay | |
| 2009/0205096 | A1 | 8/2009 | Seemann | |
| 2010/0177992 | A1 | 7/2010 | Hawbaker | |
| 2012/0060256 | A1 | 3/2012 | Parker | |
| 2013/0019378 | A1 | 1/2013 | White | |
| 2014/0345029 | A1 | 11/2014 | Saladino | |

FOREIGN PATENT DOCUMENTS

| | | | |
|---|---|---|---|
| FR | 2819384 | * | 7/2002 |
| FR | 2823954 | A1 | 10/2002 |
| FR | 2914824 | A1 | 10/2008 |
| GB | 2253776 | A | 9/1992 |
| GB | 2494142 | A | 3/2013 |

OTHER PUBLICATIONS

"REV'IT! Cayenne Jacket Review," Web Bike World®, webbikeworld.com, Aug. 2005 http://www.webbikeworld.com/r3/revit/revit-cayenne-jacket.htm, 24 pages.

"Allroad Motorcycle Jackets, Pants and Riding Suits," Allroad MC Touring, allroadendurotouring.com, Accessed: Jul. 2015 https://allroadendurotouring.com/allroad-riding-gear-apparel/allroad-riding-suits-jackets-and-pants/, 6 pages.

"REV'IT! Cayenne Jacket Review," Web Bike World®, webbikeworld.com, Aug. 2005. http://www.webbikeworld.com/r3/revit/revit-cayenne-jacket.htm.

"Allroad Motorcycle Jackets, Pants and Riding Suits," Allroad MC Touring, allroadendurotouring.com, Accessed: Jul. 2015. https://allroadendurotouring.com/allroad-riding-gear-apparel/allroad-riding-suits-jackets-and-pants/.

International Search Report and Written Opinion dated Feb. 13, 2017 in International Patent Application No. PCT/US2016/064659, 13 pages.

Communication under Rule 71(3) dated May 9, 2019 in European Patent Application No. 16816532.2, 5 pages.

* cited by examiner

DUAL-JACKET ASSEMBLY

CROSS-REFERENCE TO RELATED APPLICATIONS

This application having U.S. application No. 15/366,265 and entitled "DUAL-JACKET ASSEMBLY" claims the benefit of priority of U.S. Provisional Application No. 62/262,789, entitled "DUAL-JACKET ASSEMBLY," and filed on Dec. 3, 2015, which is incorporated by reference in its entirety.

FIELD

The present disclosure relates to a dual-jacket assembly having an inner jacket coupled to an outer jacket using a cable system.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present technology is defined by the claims.

At a high level, aspects herein are directed to a dual-jacket assembly having an inner jacket coupled to an outer jacket. In exemplary aspects, the inner jacket is configured to provide warmth to a wearer of the dual-jacket assembly, and the outer jacket is configured to provide protection from rain and other types of precipitation. The outer jacket is configured at least to be worn over the inner jacket and to be stowed in a pocket of the inner jacket when not in use. The inner jacket and the outer jacket are removably coupled using a cable system. The cable system enables the outer jacket to be quickly donned once removed from the pocket of the inner jacket. For instance, once removed from the pocket, the cable system helps to position the outer jacket so that the wearer can easily insert his arms into the armholes of the outer jacket and don the outer jacket. When the wearer no longer desires to wear the outer jacket, the wearer can remove his arms from the armholes and the cable system can then be used to pull the outer jacket back into the pocket of the inner jacket. The result is a jacket that can easily be transformed from a first jacket assembly configured to primarily provide warmth, to a second jacket assembly configured to additionally provide protection from rain and other types of precipitation. Moreover, the cable system can be disengaged from the inner jacket and the outer jacket allowing the respective jackets to be worn individually (e.g., the outer jacket may be worn without the inner jacket, and the inner jacket may be worn without the outer jacket).

The cable system comprises a plurality of cables, each coupled to the inner jacket at one end and coupled to the outer jacket at the other end. More specifically, the plurality of cables may comprise at least a first cable and a second cable, the first end of each cable being coupled to an inner-facing surface of the inner jacket and the second end of each cable being coupled to an inner-facing surface of the outer jacket. The locations at which the cable ends are coupled to the inner jacket and the outer jacket permit the outer jacket to be positioned in relation to the inner jacket so that a wearer can don the outer jacket over the inner jacket while the two jackets remain coupled. Additionally, the cable system permits a wearer to stow the outer jacket back in the pocket of the inner jacket while the two jackets remain coupled.

In exemplary aspects, the inner jacket and the outer jacket may comprise different materials. For example, the inner jacket may comprise a knitted or woven material while the outer jacket may comprise a water-proof or water-resistant material. Moreover, the outer jacket may comprise a light-weight, or ultra-lightweight material to allow the outer jacket to be easily stowed in the inner jacket when not in use without creating bulk and without adding significant weight. Because the outer jacket may be formed from a lightweight or ultra-lightweight material, the outer jacket may also comprise a plurality of reinforcement cords located at pre-determined locations on the outer jacket. The reinforcement cords may be configured to provide structure to the outer jacket at the pre-determined locations while allowing the outer jacket to maintain its light weight. All of the above makes the dual-jacket assembly suitable for outdoor activities during which the wearer may wish to quickly don and doff the outer jacket when changing conditions so require.

Aspects herein further relate to a method of manufacturing a dual-jacket assembly having an inner jacket coupled to an outer jacket using a cable system. The method may comprise providing an inner jacket having a pocket and providing an outer jacket configured at least to be worn over the inner jacket and to be stowed when not being used. The method may further comprise coupling the outer jacket to the inner jacket by a cable system. The cable system comprises a plurality of cables configured to be used by the wearer to position the outer jacket once removed from the pocket so it can be easily donned by the wearer and to stow the outer jacket in the pocket of the inner jacket when not in use. Coupling the outer jacket to the inner jacket using the cable system may comprise coupling a first end of each of the cables to the inner jacket and coupling a second end of each of the cables to the outer jacket.

BRIEF DESCRIPTION OF THE DRAWINGS

Examples of the present invention are described in detail below with reference to the attached drawing figures, wherein.

DETAILED DESCRIPTION

The subject matter of the present technology is described with specificity herein to meet statutory requirements. However, the description itself is not intended to limit the scope of this application. Rather, the inventors have contemplated that the claimed subject matter might also be embodied in other ways, to comprise different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Aspects herein relate generally to a dual-jacket assembly having an inner jacket, an outer jacket, and a cable system for removably coupling the outer jacket to the inner jacket. In one exemplary aspect, the outer jacket is configured to be worn over the inner jacket and to be stowed in a pocket on the inner jacket when not in use. In another exemplary aspect, the outer jacket is configured to be worn without the inner jacket, and in yet another exemplary aspect, the inner jacket is configured to be worn without the outer jacket. Having an inner jacket removably coupled to an outer jacket may be desirable in a potentially changing environment because the inner jacket and the outer jacket may serve different purposes. For instance, in one aspect, the inner jacket may comprise a knitted or woven material configured to provide warmth, while the outer jacket may comprise a water-resistant material.

The cable system, as described herein, may comprise a plurality of cables, each coupled to the inner jacket at one end and coupled to the outer jacket at the other end. The cable system may permit the wearer to easily don the outer jacket while wearing the inner jacket. The cable system may also be configured to be used by the wearer to stow the outer jacket in the pocket of the inner jacket when not in use. More specifically, once removed from the pocket, the cable system helps to position the outer jacket so that the wearer can easily insert her arms into the armholes of the outer jacket and don the outer jacket. When the wearer no longer desires to wear the outer jacket, the wearer can remove her arms from the armholes and the cable system can then be used to pull the outer jacket back into the pocket of the inner jacket. The cable system, moreover, is configured to be disengaged from the outer jacket. This may be advantageous when the wearer wishes, for example, to wear the outer jacket by itself and not in combination with the inner jacket.

Figure 1:
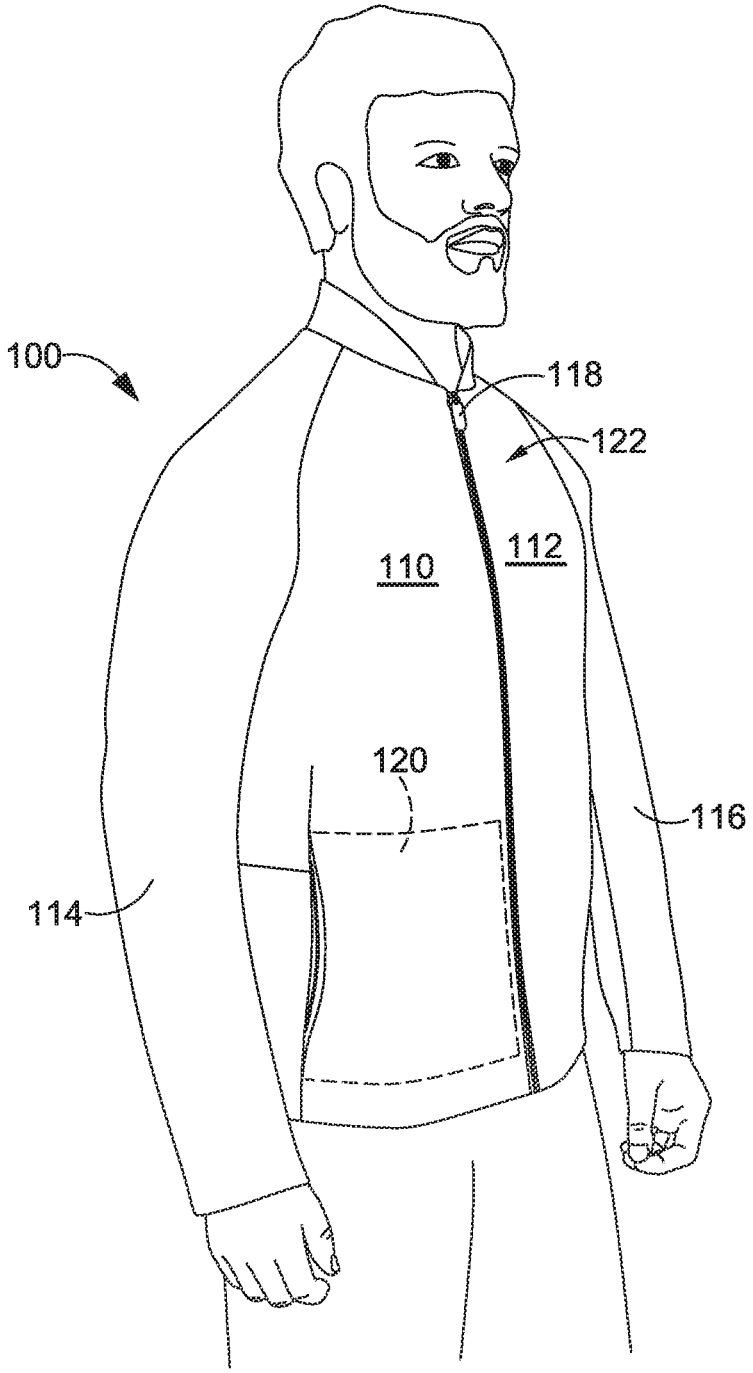
FIG. 1 illustrates a front perspective view of an exemplary inner jacket of a dual-jacket assembly in accordance with an aspect herein.
Figure 2:
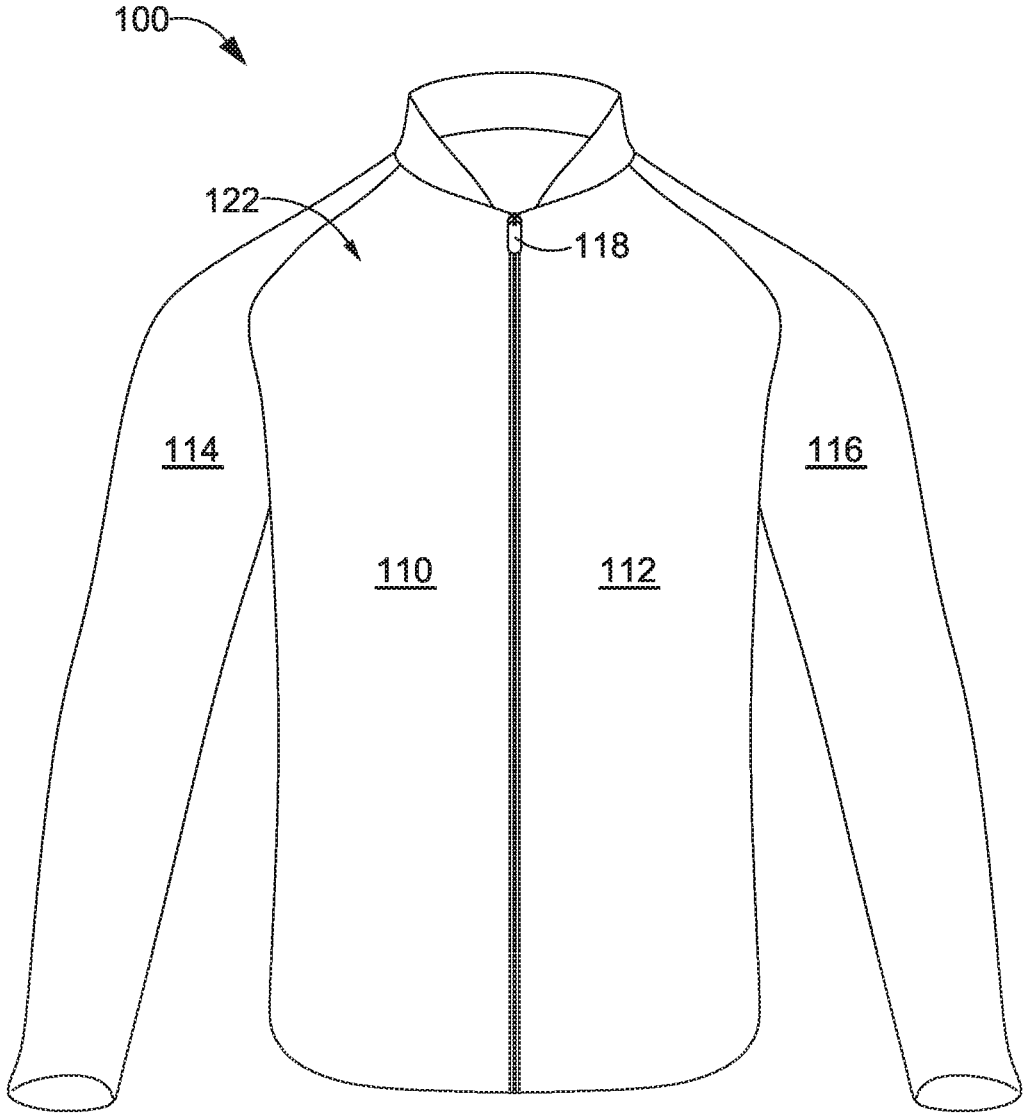
FIG. 2 illustrates a front view of the exemplary inner jacket of the dual-jacket assembly of FIG. 1 in accordance with an aspect herein.
Figure 3:
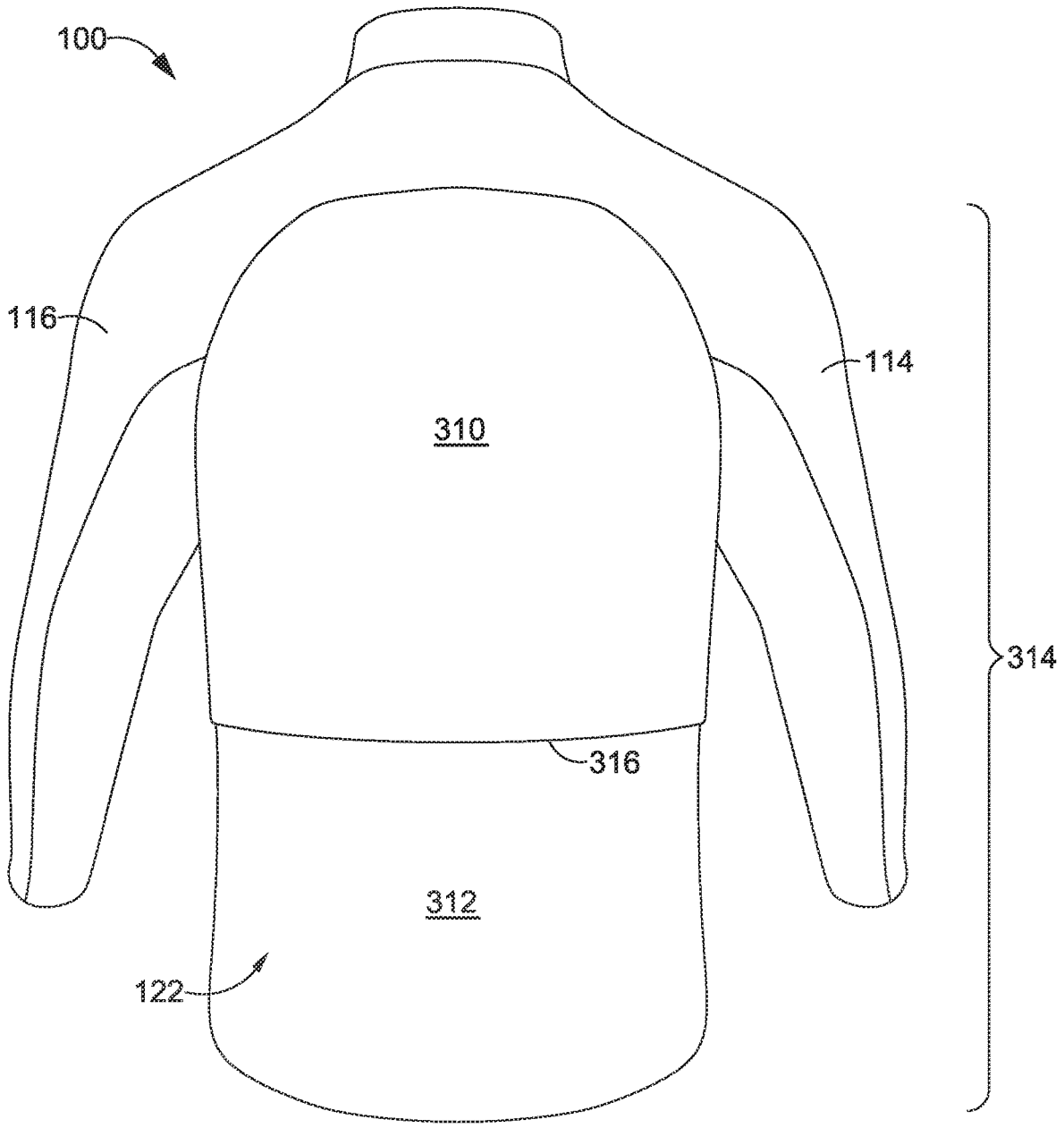
FIG. 3 illustrates a back view of the exemplary inner jacket of the dual-jacket assembly of FIG. 1 in accordance with an aspect herein.

Turning now to FIGS. 1-3, these figures depict a front perspective, front, and back view of an exemplary inner jacket 100 of a dual-jacket assembly in an as-worn configuration in accordance with aspects herein. In general, the inner jacket 100 is configured for an upper torso of a wearer when worn. In exemplary aspects, the inner jacket 100 comprises at least a right front panel 110 adapted to cover a right front torso of a wearer when the inner jacket 100 is worn and a left front panel 112 adapted to cover a left front torso area of the wearer when the inner jacket 100 is worn. The right front panel 110 and the left front panel 112 may be releasably secured to one another via a zipper-type mechanism 118 or another coupling mechanism such as buttons, snap fasteners and the like.

Continuing, the inner jacket 100 further comprises an optional right sleeve panel 114 adapted to cover a right arm of the wearer when the inner jacket 100 is worn and an optional left sleeve panel 116 adapted to cover a left arm of the wearer when the inner jacket 100 is worn. Although shown as long sleeves, it is contemplated herein that the sleeve panels 114 and 116 may be in the form of three-quarter sleeves, half sleeves, or quarter sleeves. Additional front panels and/or sleeve panels besides those shown in FIGS. 1 and 2 are contemplated herein. The inner jacket 100 may further comprise additional features, such as a side pocket 120, or another jacket pocket, and a hood (not shown) configured to be donned and doffed by a wearer.

As shown in FIG. 3, which depicts a back view of the inner jacket 100, the inner jacket 100 may further comprise an upper back panel 310 and a lower back panel 312 that together form a full back panel 314 for the inner jacket 100, where the full back panel 314 is adapted to cover a back torso area of the wearer when the inner jacket 100 is worn. The upper back panel 310 and the lower back panel 312 may be coupled or affixed directly to (or integrally formed from) the front panels 110 and 112 at one or more side seams and shoulder seams. In another exemplary aspect, the upper back panel 310 and the lower back panel 312 may be coupled or affixed to the front panels 110 and 112 via one or more side gussets or shoulder gussets. Any and all aspects, and any variation thereof, are contemplated as being within the scope herein. A midline 316 may separate the upper back panel 310 and the lower back panel 312. As will be discussed in greater detail below, there may be a back zipper-type mechanism (depicted as 910 in FIG. 9) at this midline 316 that allows access to a pocket (depicted as 522 in FIG. 5) that houses an outer jacket (depicted as 510 in FIG. 5).

The inner jacket 100 may be constructed from a variety of textile materials. The textile materials used may generally comprise knitted materials, woven materials, or a combination of knitted and woven materials. Further, different portions of the inner jacket 100 may be constructed from different textile materials. For instance, a knitted polyester material with a waterproof membrane may be used for portions of the inner jacket 100 configured to cover the shoulders of a wearer; whereas, the right front panel 110 and the left front panel 112 of the inner jacket 100 may comprise a breathable tricot membrane between two knitted layers. Any and all aspects, and any variation thereof, are contemplated as being within the scope herein.

Figure 4:
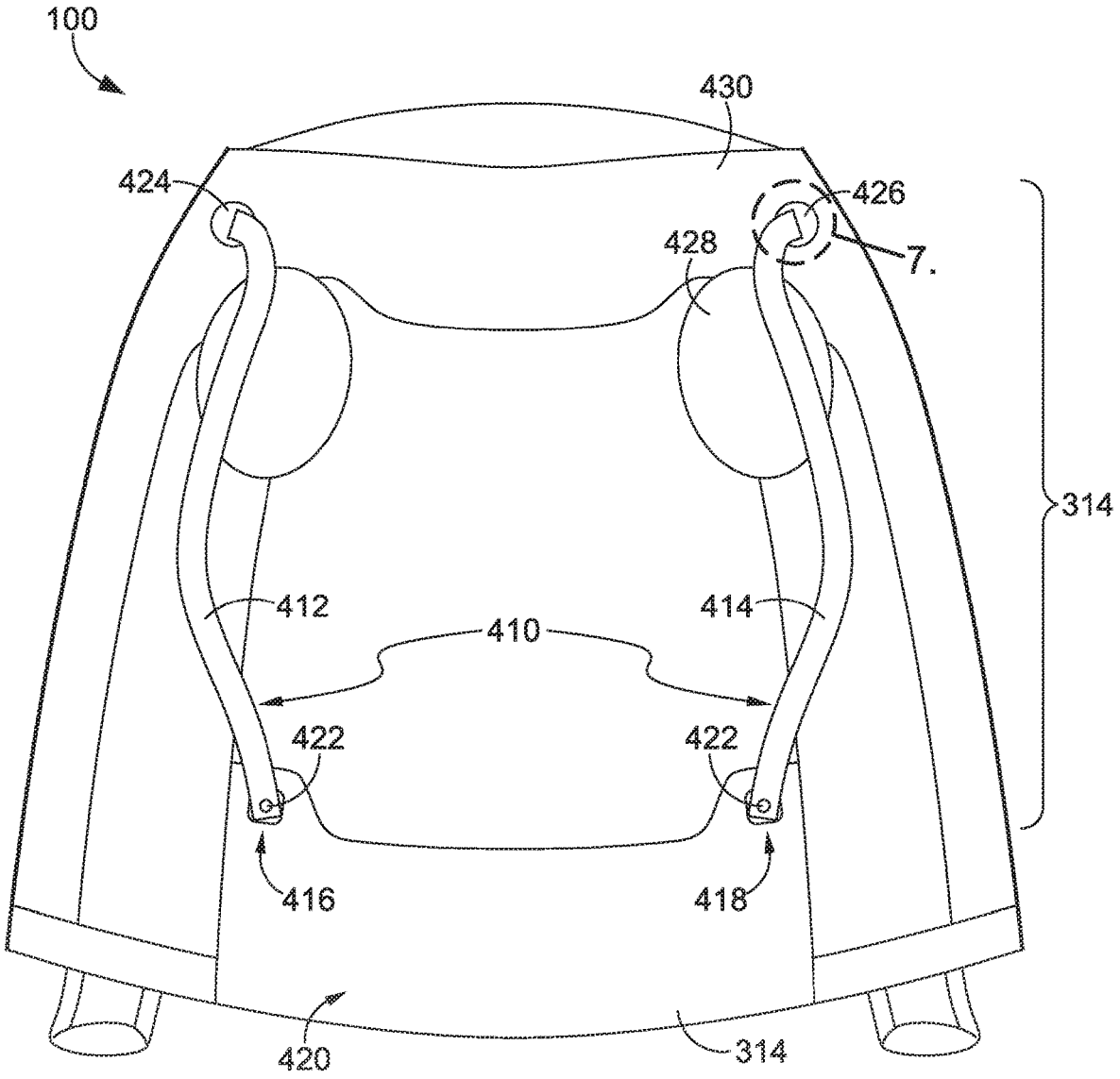
FIG. 4 illustrates a front view of an interior of the exemplary inner jacket of FIG. 1 with a cable system in accordance with an aspect herein.

As depicted in FIG. 4, which illustrates a front view of the inner-facing surface of the inner jacket 100, the inner jacket 100, in an exemplary aspect, comprises a cable system 410 used to couple the inner jacket 100 to an outer jacket (shown as 510 in FIG. 5), which will be described in greater detail below. The cable system 410 may comprise a plurality of cables, including at least a first cable 412 and a second cable 414. A first end 416 of the first cable 412 and a first end 418 of the second cable 414 may be coupled to the inner jacket 100 at a location inferior to a right and left arm sleeve holes 428. Specifically, the first ends 416 and 418 of the first cable 412 and the second cable 414 respectively may be coupled to an inner-facing surface 420 of the back panel 314 of the inner jacket 100. In an exemplary aspect, the first ends 416 and 418 of the first cable 412 and the second cable 414 respectively may be coupled to the inner jacket 100 via a snap fastener 422 using a socket and stud component, although it is contemplated herein that any other mechanism for releasably coupling the cables 412 and 414 to the inner jacket 100 may be used such as buttons, releasable adhesives, zippers, hook-and-loop fasteners, and the like. In alternative aspects, the cables 412 and 414 may be permanently secured to the inner jacket 100 through various techniques and mechanisms such as stitching, bonding, sonic welding, taping, riveting, adhesives and the like.

The first cable 412 and the second cable 414 may each further comprise a second end (shown in FIG. 10 as 514 and 1022 respectively) with an intervening portion extending between the respective ends. In FIG. 4, the intervening portions of the first cable 412 and the second cable 414 may pass through a first cable aperture 424 and a second cable aperture 426, respectively. In exemplary aspects, the first cable aperture 424 and the second cable aperture 426 may be located on the right front panel 110 and the left front panel 112, respectively, at a position superior to the right and left arm sleeve holes 428. To put it another way, the first cable aperture 424 and the second cable aperture 426 may be positioned at approximately the shoulder region of the inner jacket 100. In exemplary aspects, when donning the inner jacket 100, the wearer may position his arms within the arm sleeve holes 428 such that the intervening portions of the first cable 412 and the second cable 414 are positioned against the front torso area of the wearer. This allows the wearer to easily access the first cable 412 and the second cable 414, which is useful when stowing the outer jacket 510 of the dual-jacket assembly.

The inner jacket 100 may comprise an exterior shell layer 122 (shown in FIGS. 1-3) and an inner liner layer 430. The exterior shell layer 122 may be visible when viewing the exterior of the inner jacket 100, as shown in FIGS. 1-3, while the inner liner layer 430 (shown in FIG. 4) is visible when viewing the inner-facing surface 420 of the inner jacket 100. The first cable aperture 424 and the second cable aperture 426 may permit portions of the respective first cable 412 and second cable 414 to pass from the inner-facing surface 420 of the inner liner layer 430 to a space or void between the inner liner layer 430 and the exterior shell layer 122.

Figure 5:
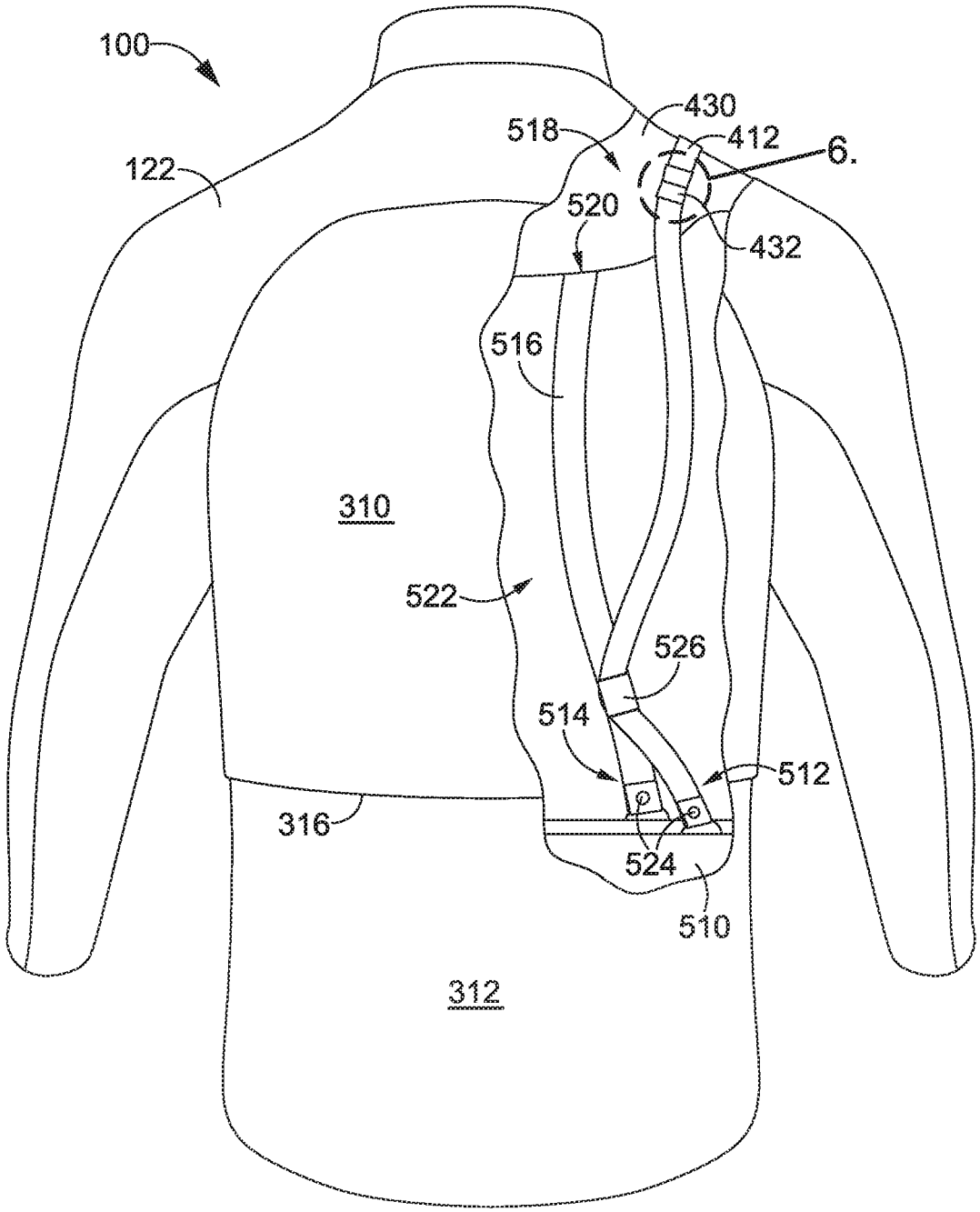
FIG. 5 illustrates a back view of the exemplary inner jacket of FIG. 1 with a portion of the inner jacket cut away to show the cable system in accordance with an aspect herein.

FIG. 5 illustrates a back view of the exemplary inner jacket 100 with a portion of the exterior shell layer 122 of the inner jacket 100 cut away to show the first cable 412 of the cable system 410 in accordance with an aspect herein. For illustrative purposes, only the right portion of the exterior shell layer 122 has been removed. Accordingly, the following disclosure relates to the right portion of the dual-jacket assembly. However, the disclosure is equally applicable to the left portion of the dual-jacket assembly.

Continuing from the first cable aperture 424 (not shown), the first cable 412 may run over the right shoulder region (e.g. the region superior to the right and left sleeve holes 428) of the inner jacket 100 between the inner liner layer 430 and the exterior shell layer 122. The second end 512 of the first cable 412 may be removably coupled to an outer jacket 510 that is stowed in a pocket 522 of the inner jacket 100. In the aspect depicted in FIG. 5, the pocket 522 comprises the entire space or void along the back panel 314 between the inner liner layer 430 and the exterior shell layer 122. In other aspects, the pocket 522 may comprise a separate compartment on the back panel 314 of the inner jacket 100. Additionally, in other aspects, the pocket 522 may be at a location other than on the back panel 314. For instance, it may be on one of the sides of the inner jacket 100. Any and all aspects, and any variation thereof, are contemplated as being within the scope herein.

As shown in FIG. 5, the exemplary cable system 410 may further comprise a third cable 516. A first end 520 of the third cable 516 may be coupled (removably or permanently) to an outer-facing surface 518 of the inner liner layer 430. Alternatively, the first end 520 of the third cable 516 may be coupled to an inner-facing surface (not shown) of the exterior shell layer 122. In one aspect, the first end 520 of the third cable 516 is coupled to the back panel 314 of the inner jacket 100 at a position generally above the midline 316 of the back panel 314. In some aspects, the first end 520 of the third cable 516 may be coupled to the back panel 314 at a position generally corresponding to the location of a wearer's shoulder blade when the inner jacket 100 is worn.

Continuing, a second end 514 of the third cable 516 may be removably coupled to the outer jacket 510 (shown as stowed in the pocket 522 of the inner jacket 100). The coupling of the second ends 512 and 514 of the first cable 412 and the third cable 516, respectively, to the outer jacket 510 is shown in greater detail in FIG. 10.

In the aspect depicted in FIG. 5, the second ends 512 and 514 of the first cable 412 and the third cable 516, respectively, are coupled to the outer jacket 510 via a snap-type mechanism 524, but it is contemplated that other methods of releasably or removably coupling or even permanently securing the second ends 512 and 514 may be used. Similarly, the first end 520 of the third cable 516 may be permanently affixed to the inner jacket 100 by a method such as stitching, but other methods of permanently securing or even releasably coupling the first end 520 of the third cable 516 to the inner jacket 100 may be used.

In exemplary aspects, the first cable 412 may be further slidably coupled to the third cable 516. For instance, the first cable 412 and the third cable 516 may be coupled via a slidable coupling mechanism 526. The slidable coupling mechanism 526 may help the first cable 412 and the second cable 414 to remain in optimal positions (i.e., adjacent to one another) while not overly restricting the movement of these cables. In one aspect, the slidable coupling mechanism 526 comprises two parallel slits in the third cable 516 through which the first cable 412 is threaded. Alternatively, the third cable 516 may be threaded through two parallel slits in the first cable 412.

Between the slidable coupling mechanism 526 and the first cable aperture 424 (not shown in FIG. 5), the first cable 412 may include a stop portion 432. In exemplary aspects, the stop portion 432 comprises a mechanism to provide optimal positioning of the outer jacket 510 when deployed from the pocket 522 of the inner jacket 100. When the outer jacket 510 is deployed from the pocket 522 (by, for example, manual deployment by the wearer), the weight of the outer jacket 510 and the wearer's pull on the outer jacket 510 causes downward movement of the first cable 412. If the first cable 412 slides downward too much or too far, the outer jacket 510 may be positioned substantially below the wearer's waistline area making it more difficult for the wearer to don the outer jacket 510 while it is still coupled to the first cable 412. In other words, when the outer jacket 510 is positioned substantially below the wearer's waistline, the wearer may have difficulty inserting his or her arms into the sleeve openings of the outer jacket 510. To counteract this, as the first cable 412 is pulled downwards, the stop portion 432 on the first cable 412 approaches the slidable coupling mechanism 526 on the first cable 412. When the stop portion 432 contacts the slidable coupling mechanism 526, the stop portion 432 prevents further downward movement of the first cable 412. Thus, the placement of the slidable coupling mechanism 526 and the stop portion 432 on the first cable 412 is designed so that the outer jacket 510 is in an optimal position for donning when the stop portion 432 meets the slidable coupling mechanism 526. Similarly, the stop portion 432 on the first cable 412 may prevent excessive upward movement of the first cable 412 when the stop portion 432 contacts the first cable aperture 424 (not shown in FIG. 5). This helps to provide optimal placement of the outer jacket 510 for stowing in the pocket 522 of the inner jacket 100, as will be described later.

Figure 6:
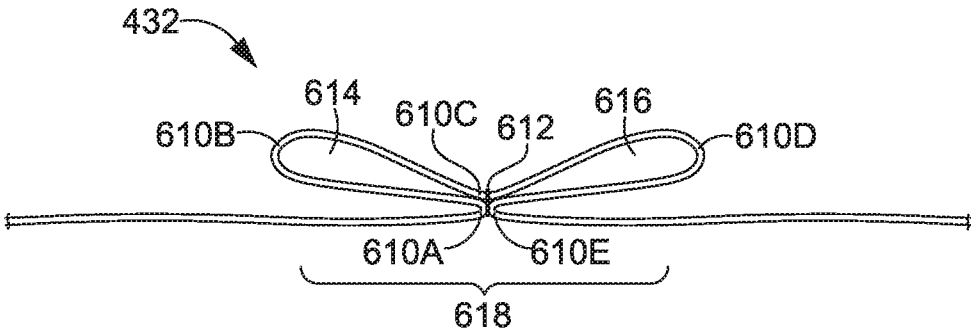
FIG. 6 illustrates a side view of an exemplary stop portion of a cable taken from reference circle 6 in FIG. 5 in accordance with an aspect herein.

In exemplary aspects, the stop portion 432 is configured so that it cannot travel past the slidable coupling mechanism 526 or the first cable aperture 424. FIG. 6 provides a blow-up, side view of the exemplary stop portion 432 taken from reference circle 6 in FIG. 5. In an exemplary aspect, the stop portion 432 may comprise a butterfly-knot configuration. For instance, the stop portion 432 may be formed by making a number of folds on the first cable 412. For instance, in one exemplary aspect, the first cable 412 may be folded over itself five times to create five folds 610A-E. The middle fold 610C may then be opened, and the various portions of the cable 412 may be secured to one another at secure point 612 via, for instance, stitching, bonding, adhesives, and the like. Other methods may be used to make the same butterfly-knot configuration, but the resulting configuration generally comprises a first loop 614 and a second loop 616, each lying generally planer with respect to a non-looped portion 618 of the cable 412.

Because the loops 614 and 616 cannot easily fit through the slits that form the slidable coupling mechanism 526 or the first cable aperture 424, the stop portion 432 ceases movement of the first cable 412 when the stop portion 432 contacts with these features. Additionally, this configuration is designed to provide a relatively flat, planar stop portion such that the stop portion 432 will not irritate or distract a wearer. It is contemplated herein that the stop portion 432 may be formed in other ways. For instance, a trim piece (formed from, for instance, fabric, rubber, plastic, foam, polyurethane, and the like) may be affixed to the first cable 412 to prevent the first cable 412 from traveling further through the first cable aperture 424 or past the slidable coupling mechanism 526. Any and all aspects, and any variation thereof, are contemplated as being within the scope herein.

As mentioned, the above disclosure is with respect to the right portions of the dual-jacket assembly. As such, there may exist a fourth cable (shown as 1020 in FIG. 10) on the left side of the dual-jacket assembly that performs the same function as the third cable 516 and is similarly coupled to the second cable 414 as described herein. The second cable 414 on the left side of the dual-jacket assembly may also include a stop portion 432 as described herein.

Figure 7:
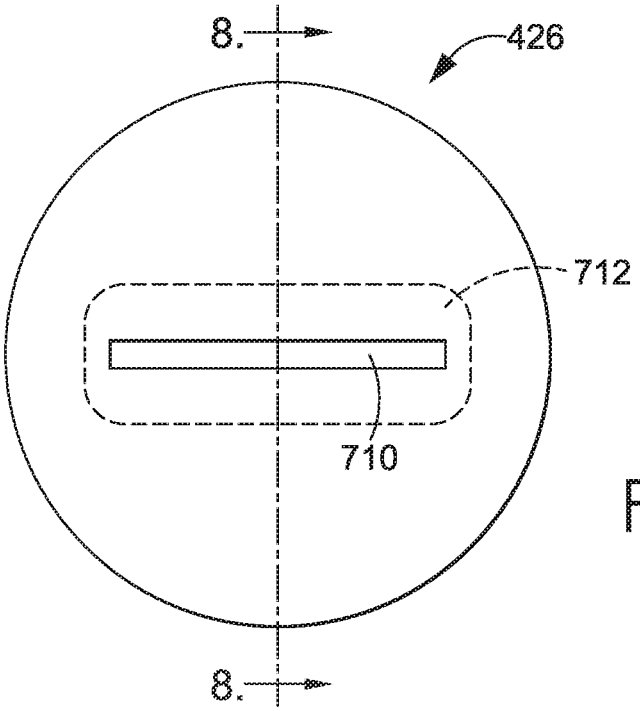
FIG. 7 illustrates a front view of an exemplary cable aperture with an exemplary trim piece taken from reference circle 7 in FIG. 4 in accordance with an aspect herein.

FIG. 7 provides a blow-up, top view of the second cable aperture 426, which is identical to the first cable aperture 424, taken from reference circle 7 in FIG. 4. The size and shape of an opening 710 of the second cable aperture 426 may generally correspond to the size and shape of the second cable 414. A trim piece 712, indicated by the dashed-line, may circumscribe the periphery of the opening 710. The shape of the trim piece 712 may generally correspond to the shape of the opening 710. The trim piece 712 may be embedded between two textile layers as shown in FIG. 8.

Figure 8:
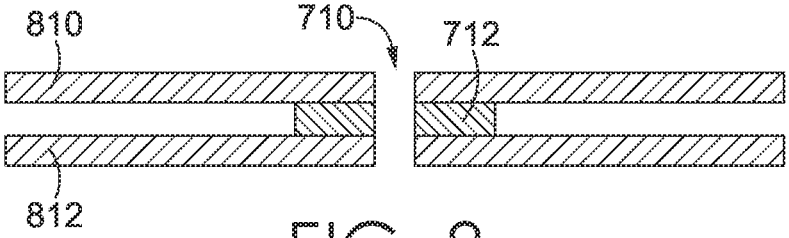
FIG. 8 illustrates a cross-sectional view of the exemplary trim piece taken at cut line 8-8 in FIG. 7 in accordance with an aspect herein.

FIG. 8 provides cross-sectional view of the second cable aperture 426, taken at cut line 8-8 in FIG. 7. The trim piece 712 circumscribes the opening 710 and may be positioned between a first textile layer 810 and a second textile layer 812. The trim piece 712 provides structure and strength to the opening 710 of the second cable aperture 426 and may be constructed from a variety of durable textile materials. For example, the trim piece 712 may be constructed from thermoplastic polyurethane, foam, fabric, leather, or any material that helps to keep the opening 710 from degrading with repetitive use and allows a cable to move through the opening 710 easily. The first cable aperture 424 may similarly comprise the trim piece 712.

Figure 9:
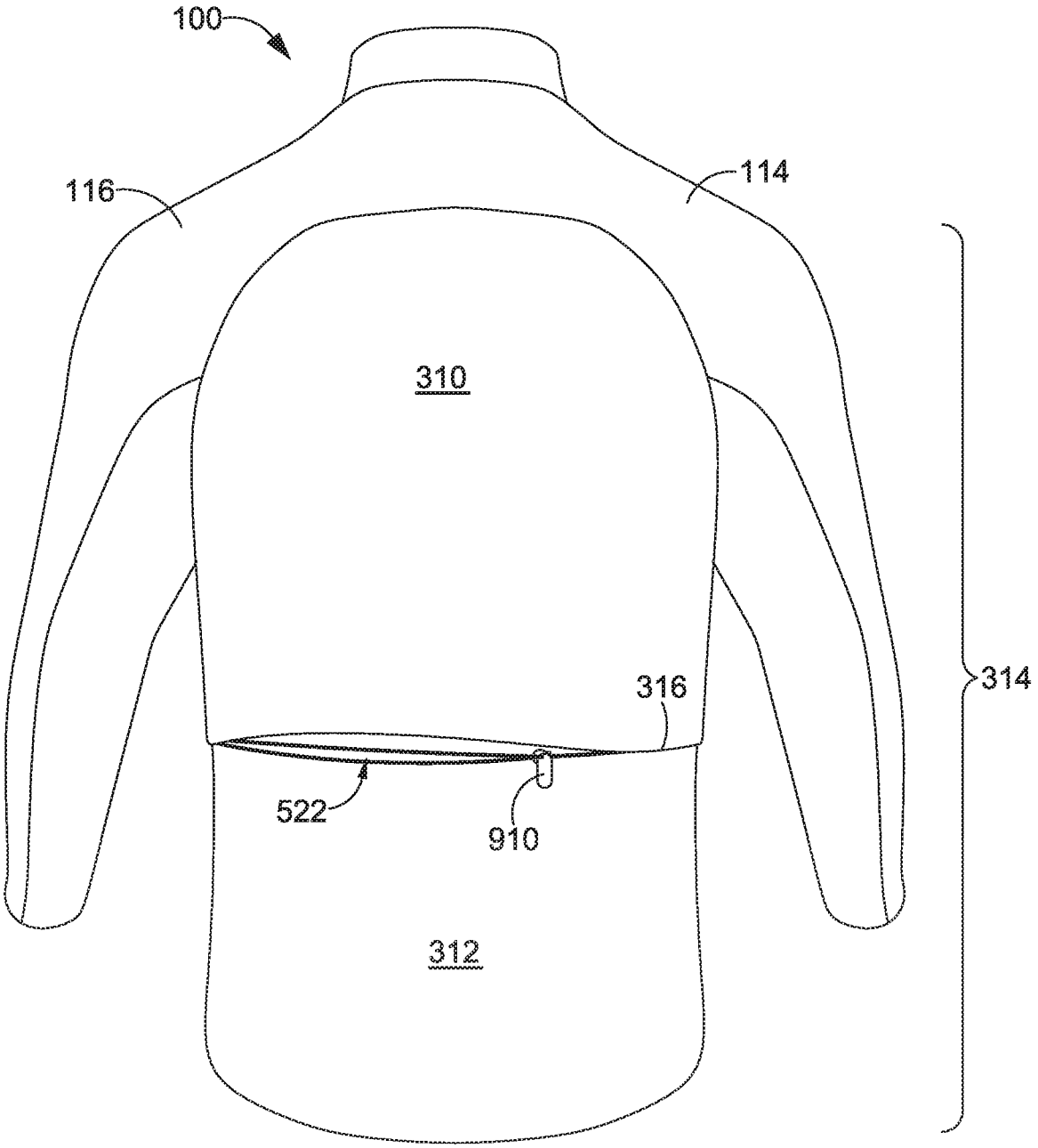
FIG. 9 illustrates a back of the exemplary inner jacket of FIG. 1 with the pocket unzipped in accordance with an aspect herein.
Figure 10:
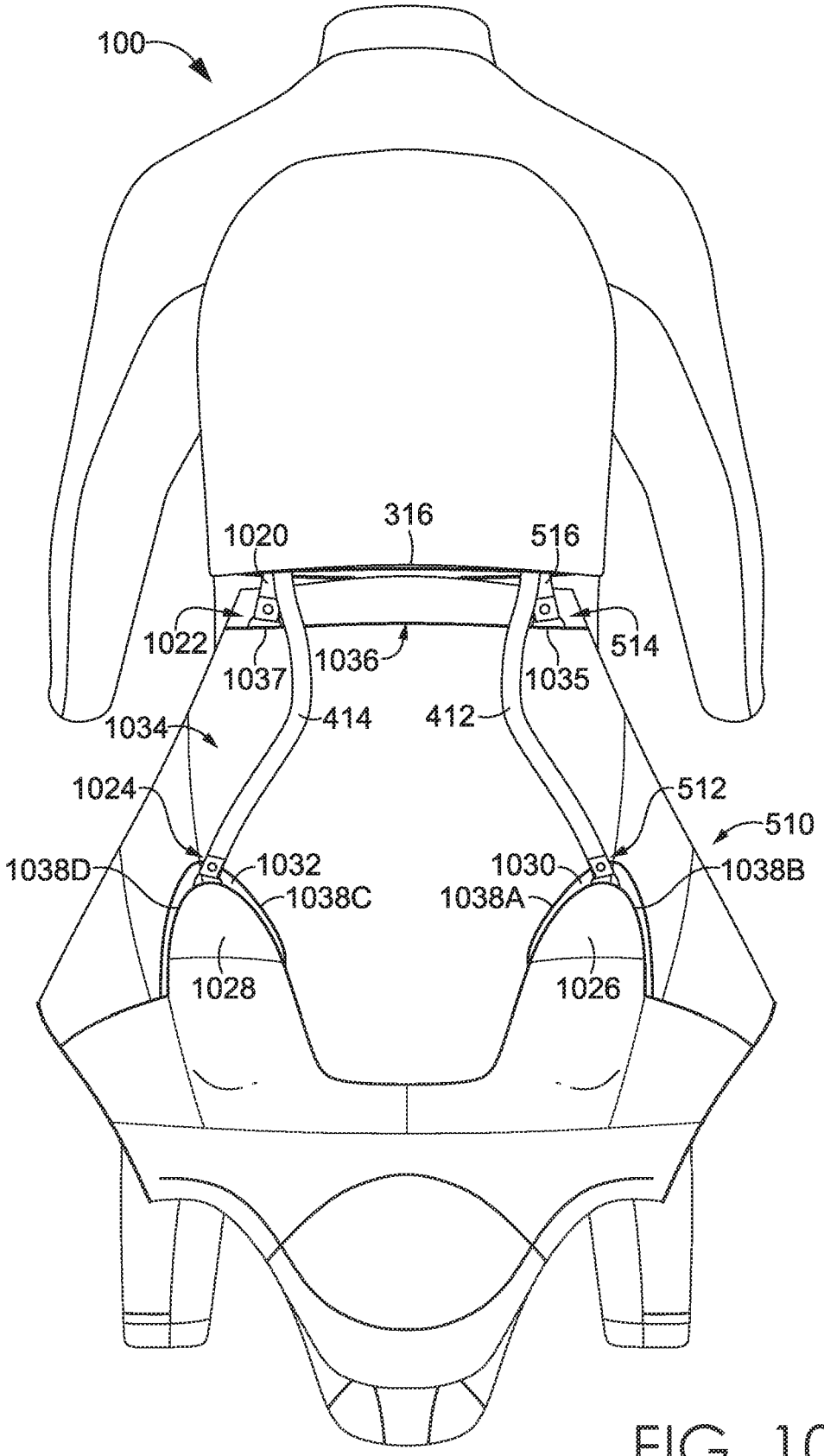
FIG. 10 illustrates a back view of an exemplary dual-jacket assembly after an outer jacket is deployed from the pocket of the inner jacket in accordance with an aspect herein.
Figure 11:
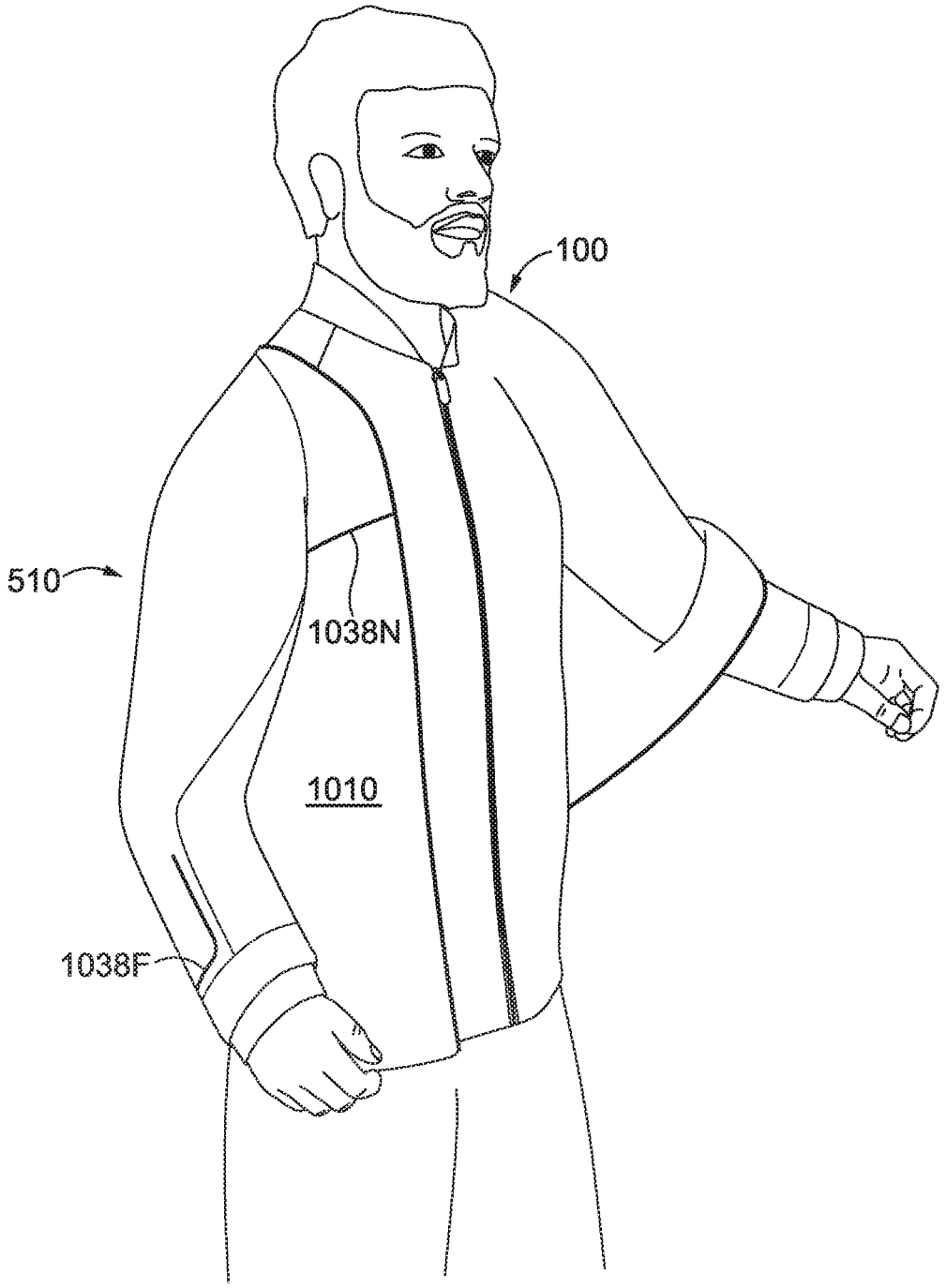
FIG. 11 illustrates a front perspective view of a wearer donning an exemplary outer jacket over an inner jacket in accordance with an aspect herein.

FIGS. 9-11 depict how the outer jacket 510 is deployed from the pocket 522 of the inner jacket 100 and donned by a wearer. Starting with FIG. 9, a back view of the inner jacket 100 is provided. As previously discussed, the midline 316 between the upper back panel 310 and the lower back panel 312 may comprise a back zipper-type mechanism 910. In exemplary aspects, the upper back panel 310 may extend slightly over the lower back panel 312 to at least partially obstruct the view of the back zipper-type mechanism 910. In other aspects, the back zipper-type mechanism 910 is visible from a back view of the inner jacket 100. The back zipper-type mechanism 910 provides access to the pocket 522 of the inner jacket 100. As explained, the pocket 522 may comprise the entire space between the exterior shell layer 122 and the inner liner layer 430 of the back panel 314. Such a design would give the outer jacket 510 ample space to lay flat within the pocket 522 of the inner jacket 100. In other exemplary aspects, the pocket 522 may comprise a discrete compartment. To access the outer jacket 510 for deployment, a wearer unzips the back zipper-type mechanism 910, as shown in FIG. 9.

After a wearer pulls out the outer jacket 510 from the pocket 522 of the inner jacket 100, the outer jacket 510 hangs from the inner jacket 100 via the cable system 410 as shown in FIG. 10. In general, the outer jacket 510 is configured for an upper torso of a wearer when worn. A more detailed description of the outer jacket 510 will be provided with respect to FIGS. 12 and 13.

As shown in FIG. 10, the cable system 410 is coupled to the outer jacket 510 at predetermined locations and is configured to place the outer jacket 510 in an optimal position for donning after deployment from the pocket 522. In an exemplary aspect, the second end 512 of the first cable 412 and the second end 1024 of the second cable 414 are coupled (removably or fixedly) to the outer jacket 510. Specifically, the second ends 512 and 1024 of the first cable 412 and the second cable 414, respectively, may be coupled to an inner-facing surface 1034 of the outer jacket 510 at a first location 1030 and second location 1032, respectively. The first location 1030 may correspond to an inferior margin of a first armhole 1026 of the outer jacket 510, and the second location 1032 may correspond to an inferior margin of a second armhole 1028 of the outer jacket 510 when the outer jacket 510 is in an as-worn configuration.

By coupling the second ends 512 and 1024 of the cables 412 and 414 to the inferior margins of the first and second armholes 1026 and 1028, a degree of tension is introduced to these areas (due to, for instance, the weight of the outer jacket 510 as it is hanging down) where the degree of tension helps to keep the armholes 1026 and 1028 in an open position. The degree of tension is created or further augmented by restricting the length of the cables 412 and 414 by use of the stop portions 432 and the slidable coupling mechanisms 526. The introduction of the degree of tension may be especially important when the outer jacket 510 is formed from an ultra-lightweight fabric as these types of fabrics tend to collapse onto themselves, making it difficult for the wearer to insert his or her arms through the first and second armholes 1026 and 1028. Moreover, by coupling the second ends 512 and 1024 of the cables 412 and 414 to the inferior margins of the first and second armholes 1026 and 1028, the remaining portion of the armholes 1026 and 1028 remain unobstructed so that a wearer can easily insert his or her arms into the armholes 1026 and 1028.

In an exemplary aspect, the second end 514 of the third cable 516 and the second end 1022 of the fourth cable 1020 are also coupled to the outer jacket 510, specifically to the inner-facing surface 1034 of the outer jacket 510 at a third location 1035 and a fourth location 1037, respectively. The third location 1035 and the fourth location 1037 may correspond generally to a midline 1036 of a back panel (shown as 1314 in FIG. 13) of the outer jacket 510. The midline 1036 of the back panel 1314 of the outer jacket 510 may align with the midline 316 of the back panel 314 of the inner jacket 100 when the outer jacket 510 is worn over the inner jacket 100. By coupling the second ends 514 and 1022 of the third and fourth cables 516 and 1020 to the midline 1036 of the outer jacket 510 as described and by fixing the first ends of the third and fourth cables 516 and 1020 as described with respect to FIG. 5, the midline 1036 of the back panel 1314 of the outer jacket 510 is prevented from falling too far below the waistline area of the wearer. This positioning may make it easier for the wearer to easily reach back and insert his or her arms into the first and second armholes 1026 and 1028.

After placing an arm in each of the first armhole 1026 and the second armhole 1028, the wearer is able to pull the outer jacket 510 up and over the wearer's shoulders, as shown in FIG. 11. In one aspect, the dual-jacket assembly is configured to permit the wearer to don the outer jacket 510 over the inner jacket 100 without uncoupling the cables from either the inner jacket 100 or the outer jacket 510.

Figure 12:
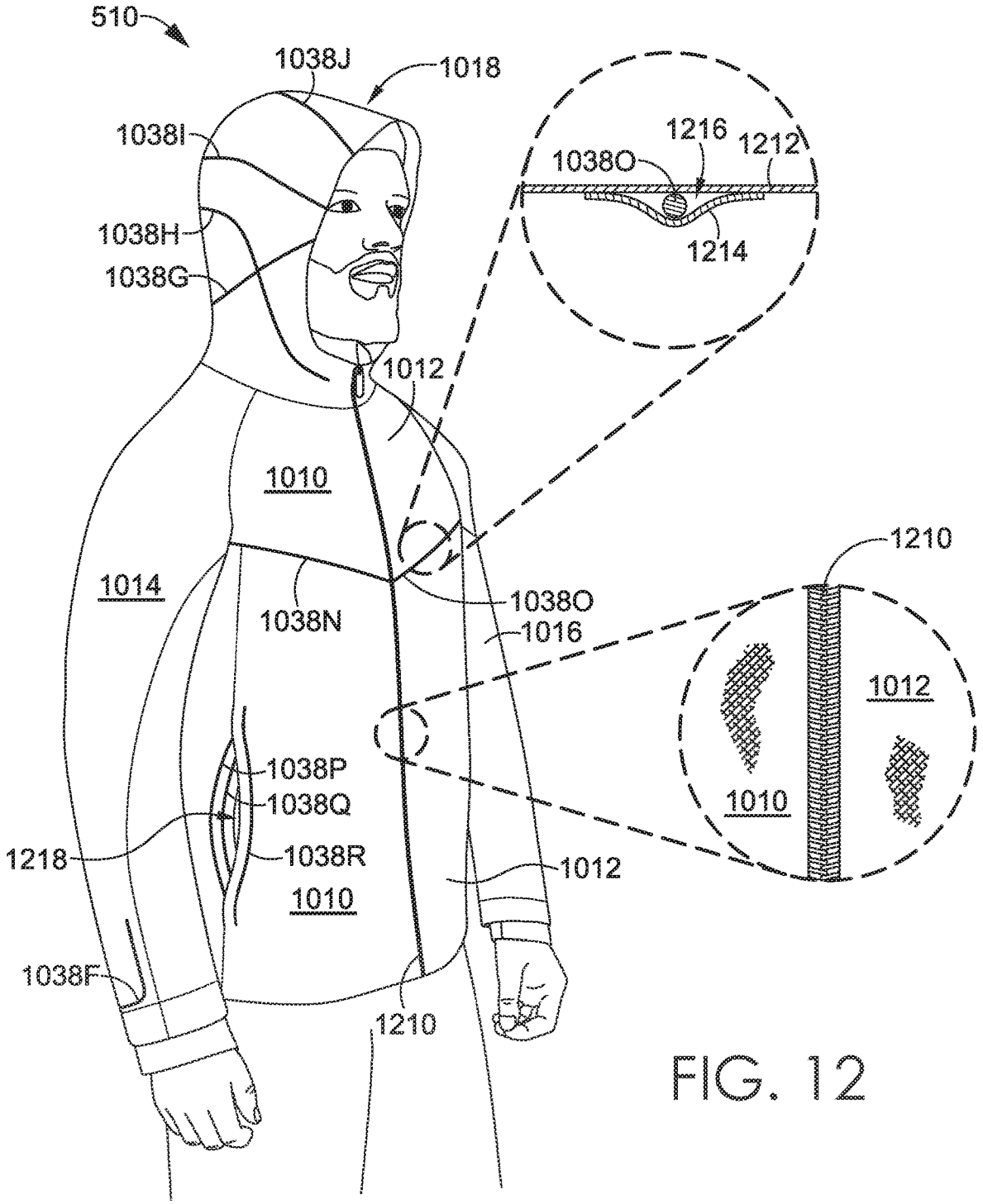
FIG. 12 illustrates a front perspective view of the wearer wearing the exemplary outer jacket over the inner jacket in accordance with an aspect herein.
Figure 13:
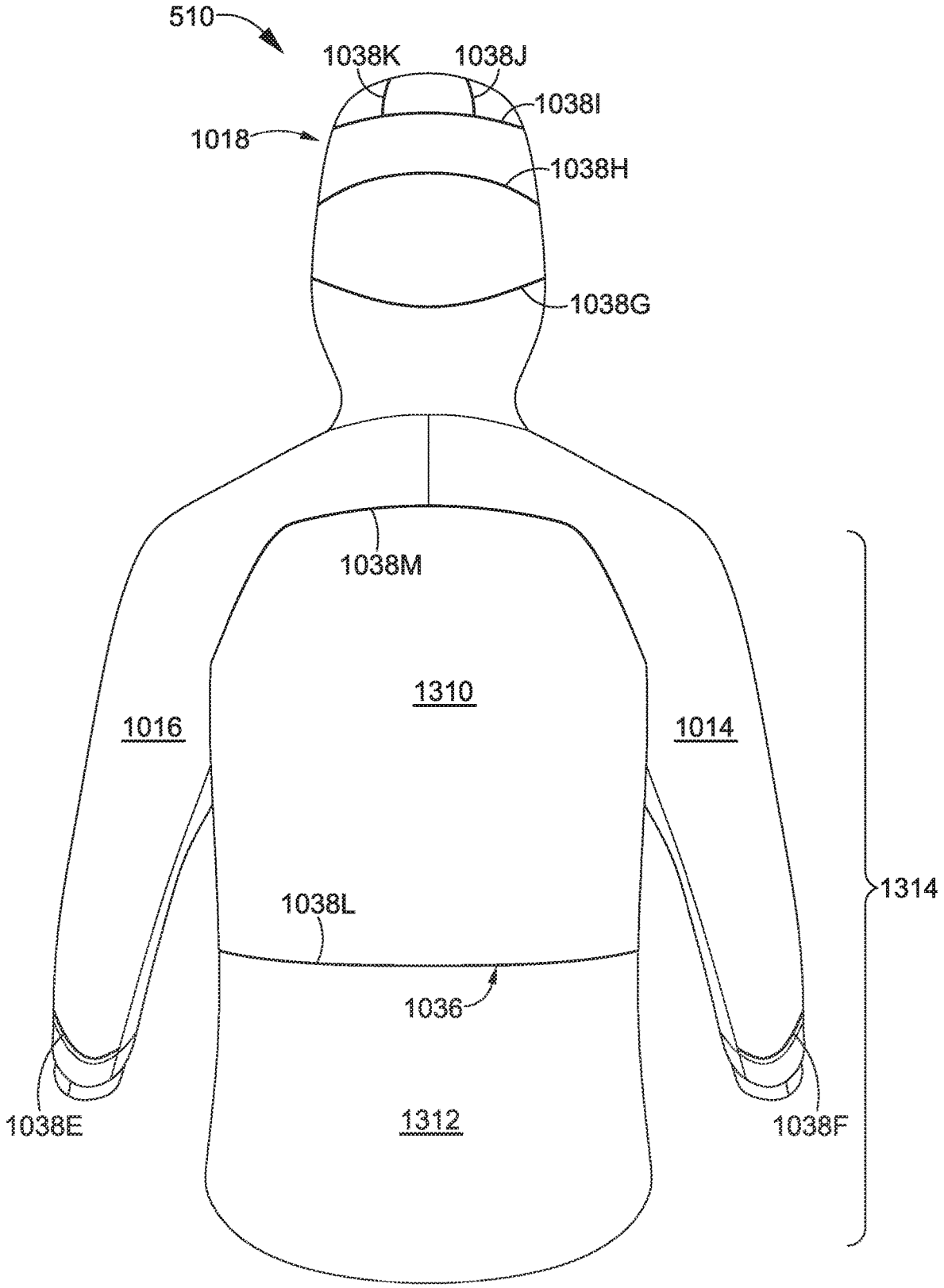
FIG. 13 illustrates a back view of an exemplary outer jacket being worn over an inner jacket in accordance with an aspect herein.
Figure 14:
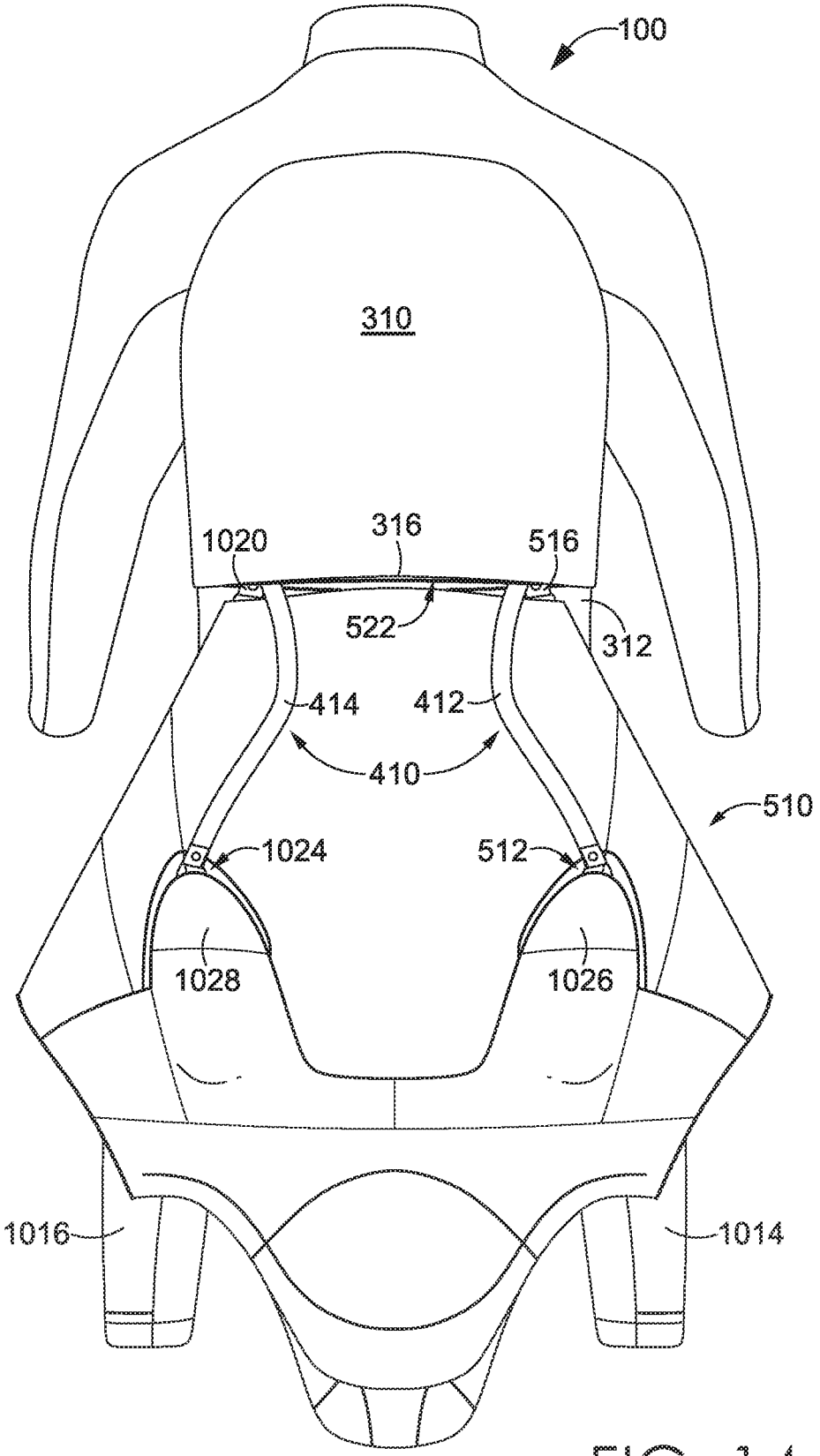
FIG. 14 illustrates a back view of the inner jacket coupled to the outer jacket of FIG. 13 after the wearer has doffed the outer jacket in accordance with an aspect herein.

Continuing to FIGS. 12-13, a perspective view and a back view, respectively, of the outer jacket 510 being worn over the inner jacket 100 is illustrated in accordance with aspects herein. In exemplary aspects, the outer jacket 510 comprises at least a right front panel 1010 adapted to cover a right front torso of a wearer when the outer jacket 510 is worn and a left front panel 1012 adapted to cover a left front torso area of the wearer when the outer jacket 510 is worn. The right front panel 1010 and the left front panel 1012 may be releasably secured to one another via a zipper-type mechanism 1210 or another coupling mechanism such as buttons, snap fasteners and the like. The outer jacket 510 further comprises an optional right sleeve panel 1014 adapted to cover a right arm of the wearer when the outer jacket 510 is worn and an optional left sleeve panel 1016 adapted to cover a left arm of a wearer when the outer jacket 510 is worn. Additional front panels and/or sleeve panels besides those shown in FIG. 12 are contemplated herein. The outer jacket 510 may further comprise additional features, such as a hood 1018 configured to be donned and doffed by a wearer.

The outer jacket 510 may be formed from a variety of textile materials. Knitted materials, woven materials, synthetic materials, or a combination of these materials may be used. In exemplary aspects, the outer jacket 510 may comprise a material with water-resistant properties. For example, the outer jacket 510 might comprise a nylon treated with a durable water repellant (DWR) finish. Also, in exemplary aspects, the outer jacket 510 may be comprised of a lightweight or ultra-lightweight material. In exemplary aspects, the material of the outer jacket 510 may have a weight between 20 $g/m^2$ to 60 $g/m^2$, between 30 $g/m^2$ to 45 $g/m^2$, or between 35 $g/m^2$ and 43 $g/m^2$, although weights above and below these values are contemplated herein.

As illustrated in FIGS. 10 and 12-13, the outer jacket 510 may also comprise a plurality of reinforcement cords 1038A-R to provide shape and structure to the lightweight material of the outer jacket 510. The reinforcement cords 1038A-R are illustrated in the figures as thicker black lines on the outer jacket 510. The reinforcement cords 1038A-R may be made of a wire material that maintains a particular shape while remaining flexible. Specifically, the reinforcement cords 1038A-R may be constructed from memory wire. It is contemplated herein, that the reinforcement cords 1038A-R may also be formed of other materials that have a degree of rigidity and yet are flexible. Exemplary materials may comprise foam, polyurethane, fabrics, leather, and the like.

The reinforcement cords 1038A-R may be strategically placed to help enable the wearer to easily don and doff the outer jacket 510. For example, as shown in FIG. 10, at least one reinforcement cord 1038A and 1038C, and, in some aspects, two additional reinforcement cords 1038B and 1038D may be placed along the inferior margins of the first armhole 1026 and the second armhole 1028 of the outer jacket 510. Reinforcement cords 1038A-D at this position may help to keep the first armhole 1026 and the second armhole 1028 open so that the wearer can easily place his or her arms through the armholes 1026 and 1028. As well, the reinforcement cords 1038A-D may help to reinforce the first armhole 1026 and the second armhole 1028 where the second ends 512 and 1024 of the first and second cables 412 and 414 respectively couple to the outer jacket 510.

Additionally, a number of reinforcement cords 1038G-K may be strategically placed around the hood 1018 of the outer jacket 510 to provide some type of structure to the hood 1018 so that it can be more easily donned (as opposed to the wearer attempting to don a hood that is crumpled onto itself due to the lightweight material used to form the hood) and to provide shape to the hood 1018 once donned. Additionally, there may be reinforcement cords 1038N-R across the front panels 1010 and 1012 and on the sides of the outer jacket 510. Reinforcement cords 1038G-H may also be placed on the right sleeve panel 1014 and left sleeve panel 1016 near the wrist openings to help maintain the wrist openings in an open state in order to make it easier for the wearer to extend his or her arms fully through the sleeves.

Another reinforcement cord 1038R may be placed around a pocket slit 1218 in the outer jacket 510 to provide structure to the slit 1218. The pocket slit 1218 may be positioned on the outer jacket 510 so that the pocket slit 1218 aligns with an opening of the side pocket 120 on the inner jacket 100 when the outer jacket 510 is worn over the inner jacket 100. The pocket slit 1218 thus provides access to the side pocket 120 of the inner jacket 100. This feature allows a wearer to utilize the side pockets 120 of the inner jacket 100 without creating additional side pockets on the outer jacket 510. Moreover, the side pockets 120 of the inner jacket 100 can be accessed via the pocket slit 1218 without requiring the wearer to unzip or remove the outer jacket 510 to gain access to the side pockets 120 of the inner jacket 100.

In exemplary aspects, the plurality of reinforcement cords 1038A-R may be secured directly to either the inner-facing surface 1034 of the outer jacket 510 or to an outer-facing surface of the outer jacket 510. In another exemplary aspect, the reinforcement cords 1038A-R may be encased within a channel formed by the lightweight material of the outer jacket 510, as shown by the cross-sectional view of the reinforcement cord 10380. In this view, a channel 1216 is formed by a first textile piece 1212 and a second textile piece 1214, and the reinforcement cord 10380 is encased within the channel 1216. In aspects, the first textile piece 1212 and the second textile piece 1214 may comprise the same textile piece that is folded over onto itself to form a hem or seam. As shown, the reinforcement cord 10280 is cylindrical shaped, but it may comprise other shapes in different aspects. Further, the plurality of reinforcement cords 1038A-R may be glued or bonded within the seams of the outer jacket 510.

As previously mentioned, the outer jacket 510 may also comprise a zipper-type mechanism 1210 to releasably couple the right front panel 1010 to the left front panel 1012 of the outer jacket 510. Often, zipper-type mechanisms may be coupled to textile materials through an intervening layer of zipper tape. In one aspect of the technology, however, the zipper-type mechanism 1210 is directly attached to the lightweight material of the outer jacket 510, as shown in the blow-up view of the zipper-type mechanism 1210 in FIG. 12. Omitting zipper tape to secure the zipper-type mechanism 1210 to the lightweight material maintains the lightweight aspect of the outer jacket 510 and provides a low-profile to the zipper-type mechanism 1210.

Turning to FIG. 13, a back view of the outer jacket 510 further depicts the placement of reinforcement cords 1038E-M to provide shape and structure to the outer jacket 510. The outer jacket 510 comprises a full back panel 1314 that includes an upper back panel 1310 and a lower back panel 1312. In exemplary aspects, a reinforcement cord 1038L is located on the horizontally-oriented midline 1036 of the back panel 1314, which, as shown in FIG. 10, may correspond generally to the placement of the second ends 514 and 1022 of the third and fourth cables 516 and 1020, respectively, on the outer jacket 510. While the outer jacket 510 is shown being worn over the inner jacket 100, a wearer may desire to wear the outer jacket 510 on its own. The plurality of reinforcement cords 1038A-R may provide sufficient shape and structure to the outer jacket 510 such that the outer jacket 510 may be worn on its own without relying on the structure of any underlying jacket.

Figure 15:
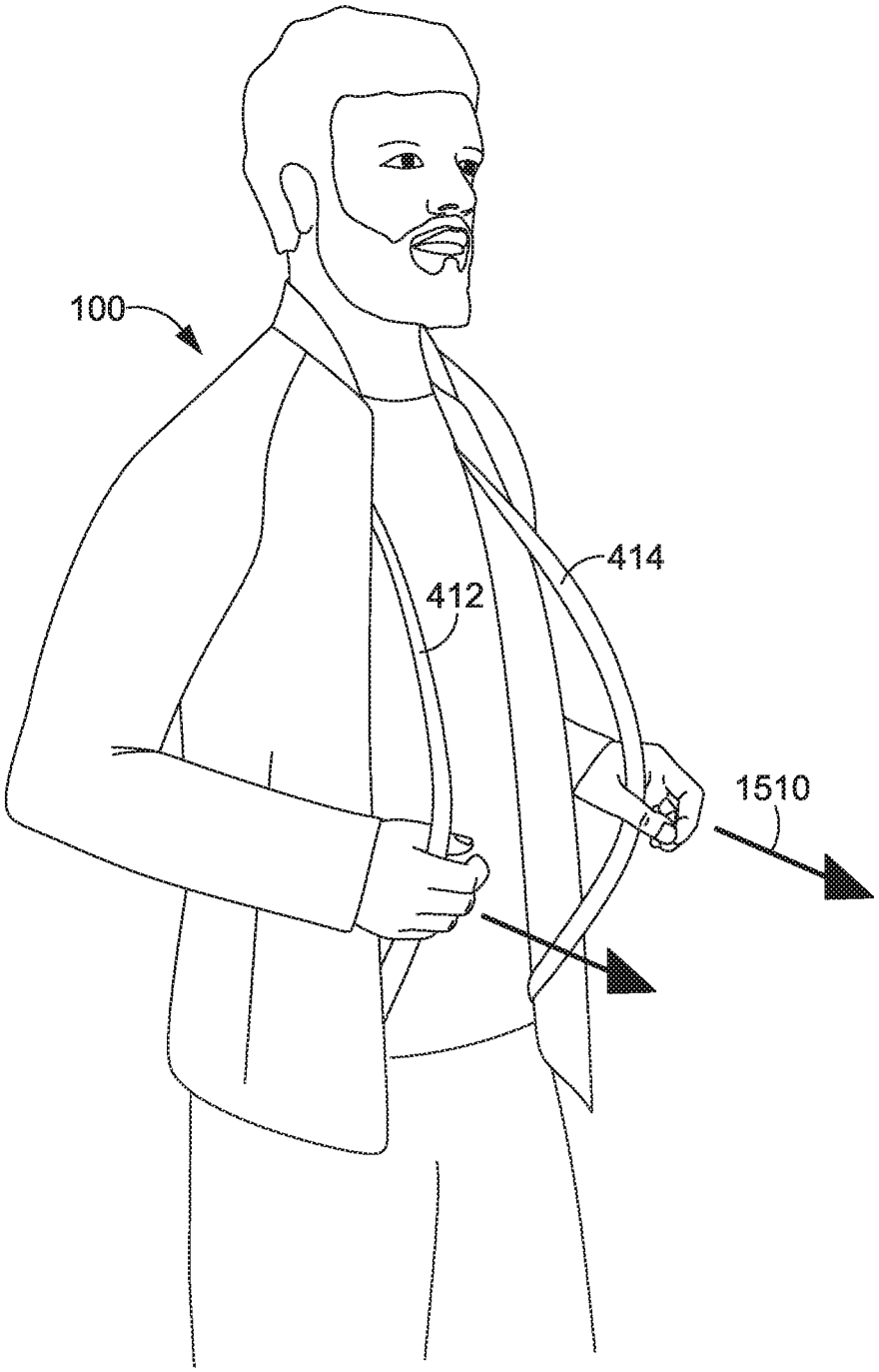
FIG. 15 illustrates a front perspective view of the wearer using the cable system to stow the outer jacket in the pocket of the inner jacket in accordance with an aspect herein.
Figure 16:
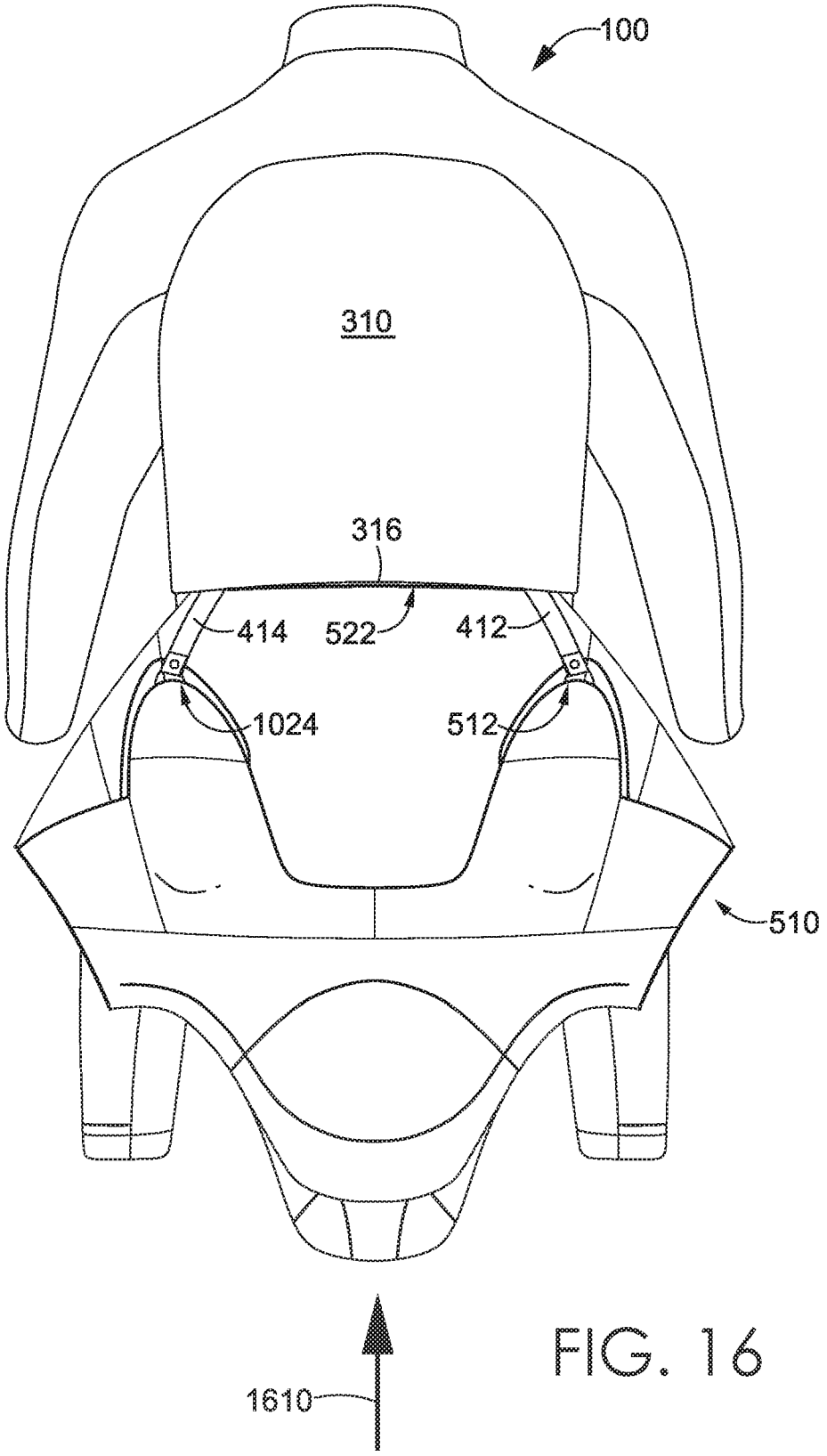
FIG. 16 illustrates a back view of the inner jacket coupled to the outer jacket where the outer jacket is being pulled into the pocket of the inner jacket using the cable system in accordance with an aspect herein.
Figure 17:
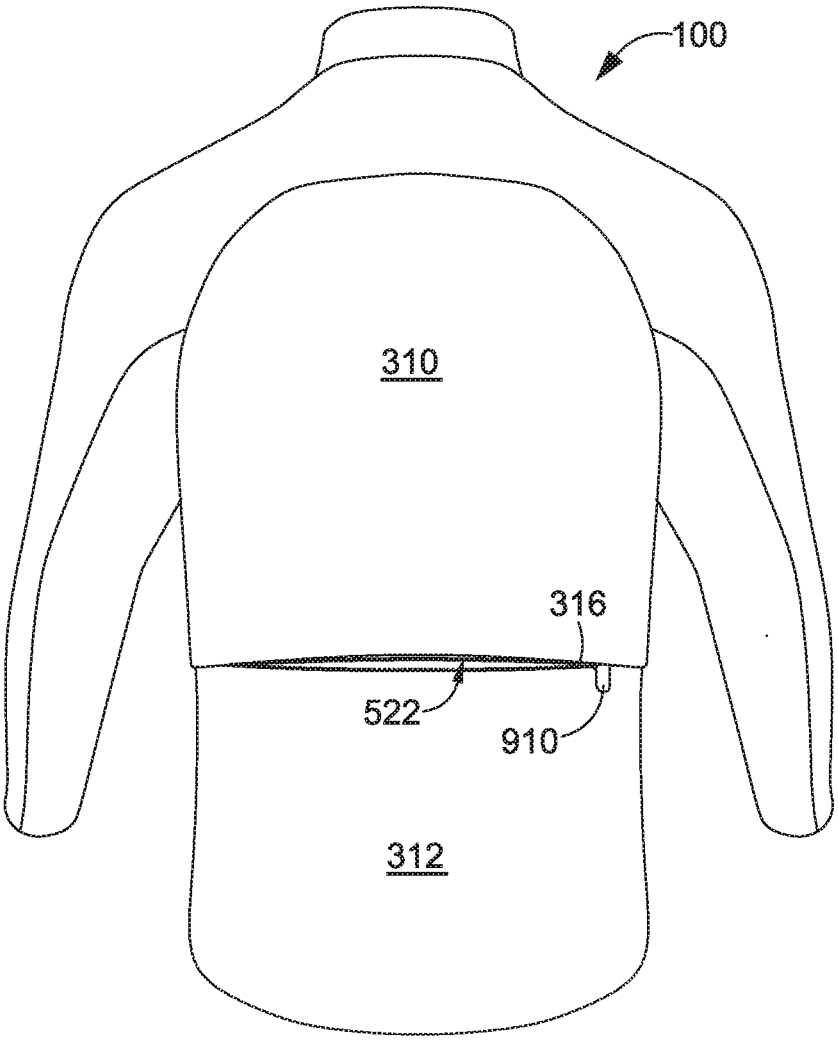
FIG. 17 illustrates a back view of the inner jacket after the outer jacket has been stowed in the pocket of the inner jacket in accordance with an aspect herein.

FIGS. 14-17 illustrate how the cable system 410 may be used to stow the outer jacket 510 when the outer jacket 510 is not being used. Starting with FIG. 14, a wearer may remove his or her arms from the sleeve panels 1014 and 1016 of the outer jacket 510, letting the outer jacket 510 hang out of the pocket 522 of the inner jacket 100 via the cable system 410. As shown in FIG. 15, the wearer may pull forward on the first cable 412 and the second cable 414 in the direction shown by arrow 1510. Because the intervening portions of the first and second cables 412 and 414 pass over the shoulder area of the inner jacket 100, this forward pull by the wearer exerts an upward force on the second ends 512 and 1024 of the first and second cables 412 and 414, respectively, which are coupled to the outer jacket 510. Accordingly, pulling forward on the first cable 412 and the second cable 414 moves the outer jacket 510 upward or superiorly. This resulting movement on the outer jacket 510 is shown in FIG. 16, in which arrow 1610 shows the direction in which the outer jacket 510 moves when the wearer pulls on the first cable 412 and the second cable 414. A continued forward pull by the wearer causes the outer jacket 510 to be pulled up into pocket 522 of the inner jacket 100. In some aspects, pulling on the first cable 412 and the second cable 414 may work to pull the outer jacket 510 completely up into the pocket 522 of the inner jacket 100. In other aspects, pulling on the cables 412 and 414 pulls the outer jacket 510 at least partially into the pocket 522 of the inner jacket 100, while the wearer can push the remaining portion of the outer jacket 510 into the pocket 522.

As described, the first cable 412 and the second cable 414 may include the stop portions 432 at a point on the cables 412 and 414 between the cable apertures 424 and 426 and the slidable coupling mechanisms 526. As previously discussed, the stop portions 432 may be configured so that they cannot pass through the cable apertures 424 and 426. Accordingly, as the wearer continues to pull forward on the first cable 412 and the second cable 414, the stop portions 432 on the cables 412 and 414 contact the cable apertures 424 and 426. Because the stop portions 432 cannot pass through the cable apertures 424 and 426, the stop portions prevent further movement of the cables 412 and 414 through the cable apertures 424 and 426 and further upward movement of the outer jacket 510. In exemplary aspects, the placement of the stop portions 432 on the first and second cables 412 and 414 with respect to the locations of the first and second cable apertures 424 and 426 is designed to place the outer jacket 510 in an optimal position for being stowed in the pocket 522. For instance, portions of the outer jacket 510 that are not pulled into the pocket 522 via the wearer exerting a forward pull on the cables 412 and 414 may be positioned at the waistline area of the wearer allowing the wearer to easily reach around to finish stowing the outer jacket 510 in the pocket 522. Once the entire outer jacket 510 is stowed in the pocket 522 of the inner jacket 100, as show in FIG. 17, the pocket 522 may be closed by coupling the upper back panel 310 and the lower back panel 312 of the inner jacket 100 via the back zipper-type mechanism 910.

Figure 18:
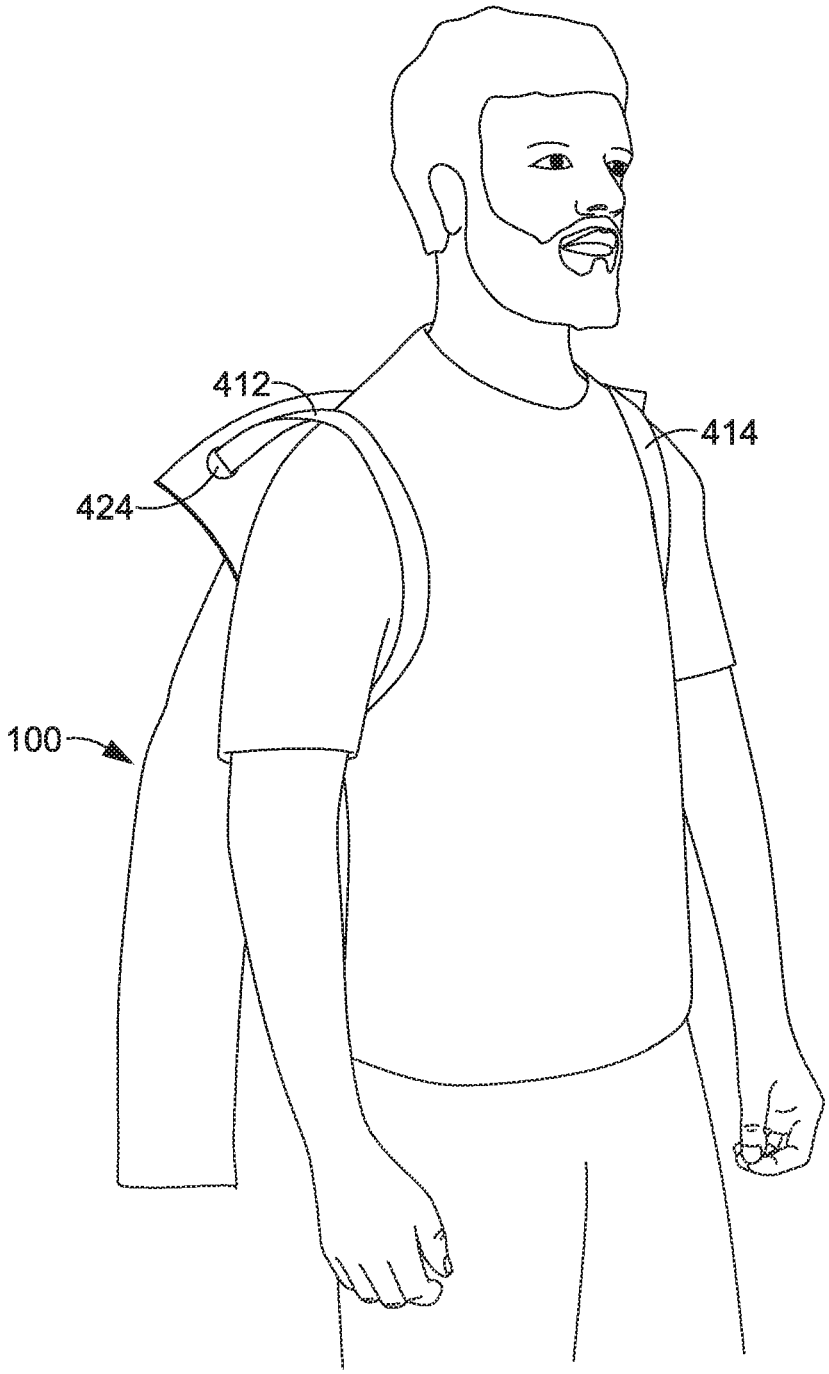
FIG. 18 illustrates a front perspective view of a wearer using the cable system to wear an exemplary dual-jacket assembly on the wearer's back in accordance with an aspect herein.

As explained, the cable system 410 may be used to couple the inner jacket 100 to the outer jacket 510, ensure optimal placement of the outer jacket 510 when deployed from the pocket 522 for donning the outer jacket 510, and help the wearer stow the outer jacket 510 in the pocket 522 of the inner jacket 100 after doffing the outer jacket 510. But FIG. 18 shows an additional use of the cable system 410. In FIG. 18, the cable system 410 provides a method of carrying the inner jacket 100 (and optionally stowed outer jacket 510) when the wearer does not wish to wear the inner jacket 100. As previously described, the first cable 412 and the second cable 414 form loops along the inner-facing surface 420 of the inner jacket 100. A wearer may position his or her arms through those loops without inserting his or her arms into the arm sleeve holes 428 of the inner jacket 100. By doing so, the wearer can carry the inner jacket 100 on his or her back in a similar fashion to carrying a backpack, without having to wear the inner jacket 100.

Figure 20:
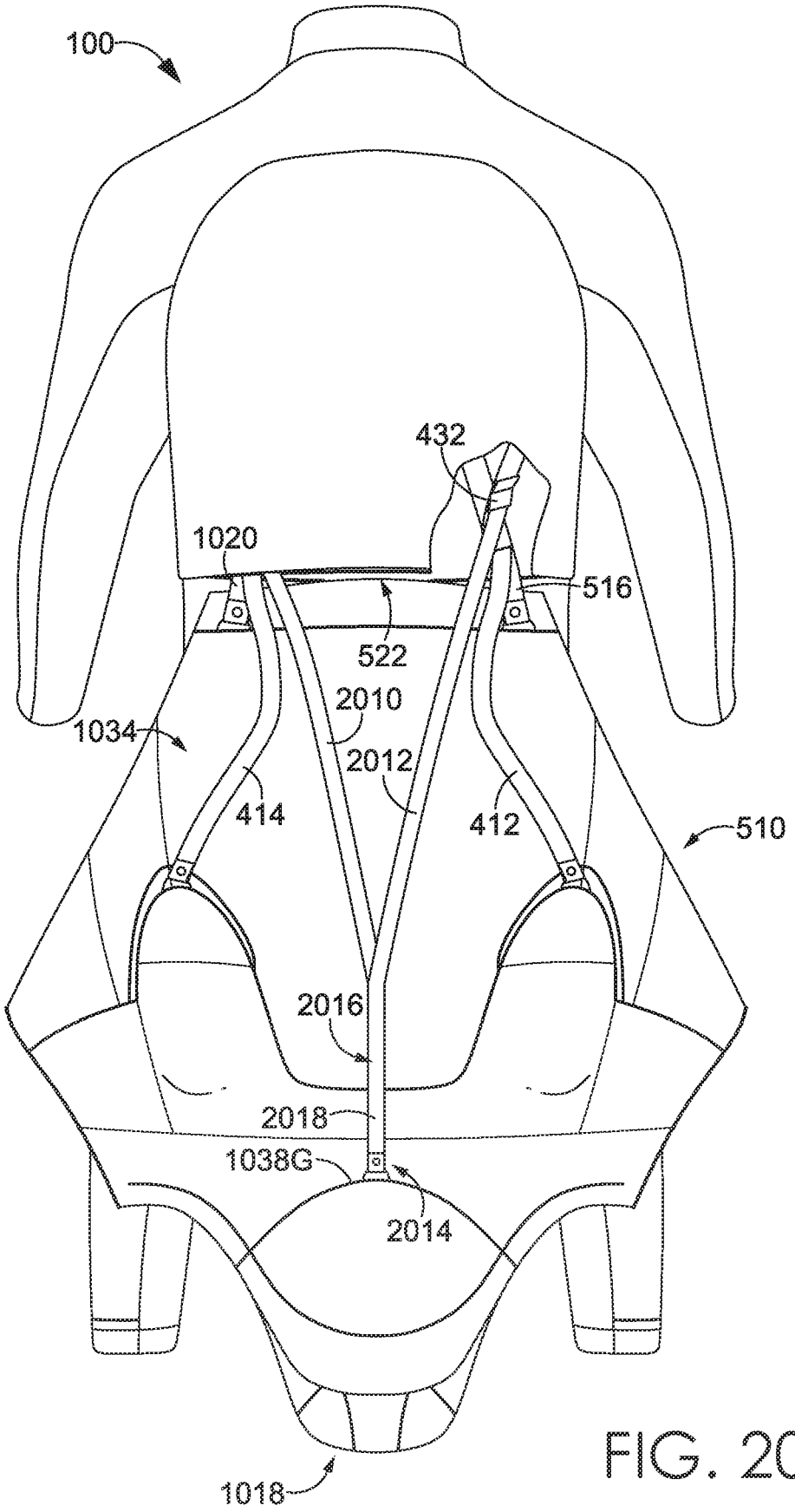
FIG. 20 illustrates a back view of an alternative cable configuration where an inner jacket is coupled to an outer jacket after the outer jacket is deployed from the pocket of the inner jacket in accordance with an aspect herein.

An alternative configuration for the cable system is shown in FIG. 20, which provides a back view of an inner jacket 100 coupled to an outer jacket 510, where the outer jacket 510 is deployed from the pocket 522 of the inner jacket 100 in accordance with aspects herein. FIG. 20 also depicts a portion of the inner jacket 100 cut away. In this configuration, the cable system 410 further comprises a fifth cable 2016 coupled to the first cable 412, the second cable 414, and the outer jacket 510. The fifth cable 2016 may comprise a Y-shaped cable having a first portion 2012 permanently or releasably coupled to the first cable 412 (shown in the cut away section), and a second portion 2010 permanently or releasably coupled to the second cable 414, where the first portion 2012 and the second portion 2010 may join to form a third portion 2018 that couples to the outer jacket 510.

The first portion 2012 and the second portion 2010 of the fifth cable 2016 may be coupled to the first cable 412 and the second cable 414, respectively, at the stop portions 432 on the first cable 412 and the second cable 414. The fifth cable 2016 may be coupled to the inner-facing surface 1034 of the outer jacket 510 at an end 2014 of the third portion 2018 opposite of the first portion 2012 and the second portion 2010. The end 2014 of the third portion 2018 may couple to the outer jacket 510 at an inferior margin of the hood 1018 where this location generally corresponds to the posterior neck region of a wearer when the outer jacket 510 is being worn. In exemplary aspects, the reinforcement cord 1038G may help to provide reinforcement to this coupling point. The fifth cable 2016 adds a fifth attachment point between the inner jacket 100 and the outer jacket 510 that aids in positioning the outer jacket 510, after being deployed from the pocket 522 of the inner jacket 100, for easier donning. Further, by coupling the fifth cable 2016 to the first cable 412 and the second cable 414, the fifth cable 2016 can also assist in the retraction of the outer jacket 510 into the pocket 522 of the inner jacket 100 when a wearer exerts tension on the first and second cables 412 and 414 (i.e., it can help draw the hood portion of the outer jacket 510 into the pocket 522).

Figure 19:
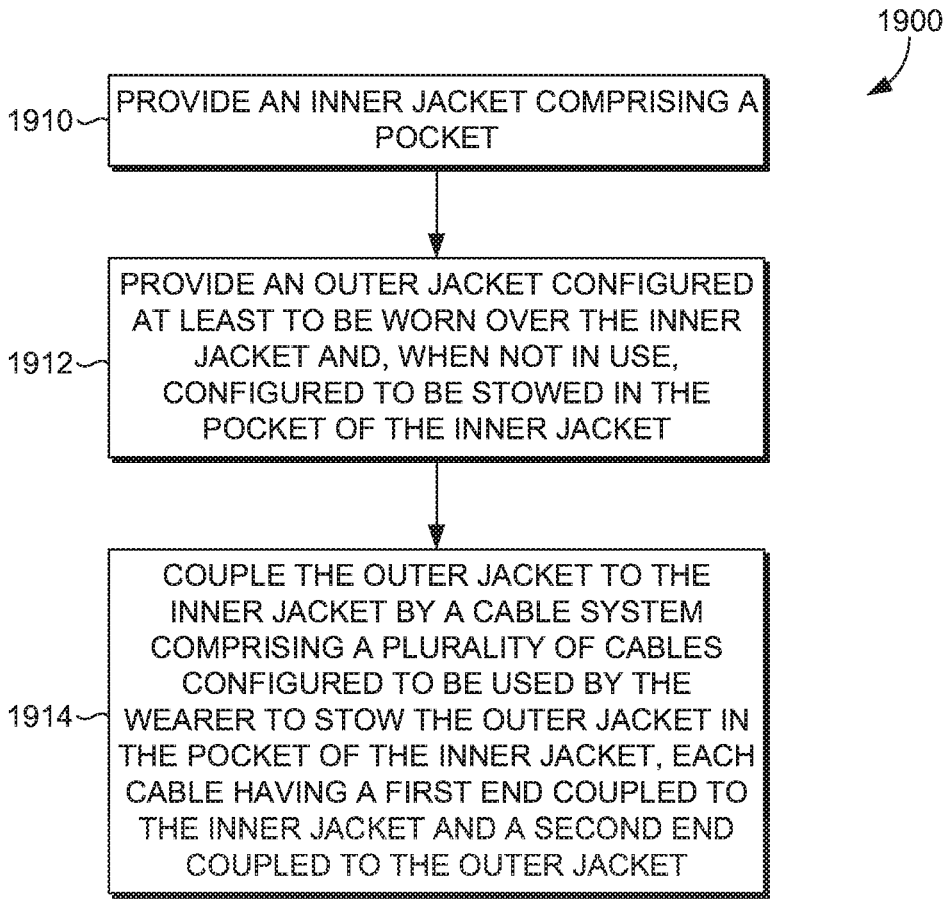
FIG. 19 illustrates a flow diagram of an exemplary method of manufacturing a dual-jacket assembly in accordance with an aspect herein.

With respect to FIG. 19, FIG. 19 depicts a flow diagram of an exemplary method 1900 of manufacturing a dual-jacket assembly having an inner jacket (such as the inner jacket 100) coupled to an outer jacket (such as the outer jacket 510) by a cable system (such as the cable system 410). At step 1910 of the method 1900, an inner jacket comprising a pocket is provided, such as the exemplary inner jacket provided in FIGS. 1-3. Next, at step 1912, an outer jacket is provided, the outer jacket being configured at least to be worn over the inner jacket, and, when not in use, configured to be stowed in the pocket of the inner jacket.

An exemplary outer jacket is illustrated in FIGS. 10-13. In these figures, the outer jacket is already coupled to the inner jacket, but it is contemplated that the outer jacket may be uncoupled to the inner jacket. As discussed in detail with respect to FIGS. 10-13, the outer jacket may comprise a plurality of reinforcement cords at predetermined locations on the outer jacket. These reinforcement cords may be adapted to provide structure and reinforcement to the outer jacket at those predetermined locations, such as the along the inferior margin of the armholes, along the wrist opening of the arm sleeves, along the hood, and various other locations. The reinforcement cords may comprise a memory wire or another rigid yet flexible material that provides both support and flexibility.

Lastly, the method comprises step 1914, at which the outer jacket is coupled to the inner jacket by a cable system. The cable system comprises a plurality of cables, each cable having a first end and a second end. In an exemplary aspect, the coupling of the outer jacket to the inner jacket may comprise coupling the first end of each of the plurality of cables to the inner jacket and coupling the second end of each of the plurality of cables to the outer jacket. The plurality of cables may be configured to be used by a wearer to position the outer jacket for easier donning after the outer jacket is deployed from the pocket of the inner jacket. As well, the plurality of cables may be used to stow the outer jacket in the pocket of the inner jacket when not in use. An exemplary cable system used in this method is depicted in FIGS. 4-5.

In one aspect, the plurality of cables comprises four cables. The first ends of each of the first cable and the second cable may be coupled to an inner-facing surface of the inner jacket. The second end of the first cable may be coupled to an inner-facing surface of the outer jacket at a first location corresponding to an inferior margin of a first armhole of the outer jacket, and the second end of the second cable may be coupled to the inner-facing surface of the outer jacket at a second location corresponding to an inferior margin of a second armhole of the outer jacket Continuing, the first ends of each of the third cable and the fourth cable may be coupled to an inner portion of the pocket of the inner jacket. For example, the first ends of each of the third cable and the fourth cable may be coupled to an outer-facing surface of an inner liner layer of the inner jacket or an inner-facing surface of an exterior shell layer of the inner jacket. In some aspects, these ends may be coupled to the inner jacket at a point above the opening of the pocket, and that point may generally correspond to the shoulder blade region of the wearer when the inner jacket is worn. The second end of the third cable may be coupled to the inner-facing surface of the outer jacket at a third location corresponding generally to a horizontal midline of a back panel of the outer jacket on a right side of a vertical midline that bisects the outer jacket into right and left halves. Similarly, the second end of the fourth cable may be coupled to the inner-facing surface of the outer jacket at a fourth location corresponding generally to the horizontal midline of the back panel of the outer jacket on a left side of the vertical midline that bisects the outer jacket into right and left halves. The coupling of the plurality of cables to the inner jacket and the outer jacket are discussed further with reference to FIGS. 4-5 and 10.

From the foregoing, it will be seen that aspects herein are well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible aspects may be made without departing from the scope thereof, it is to be understood that all matter herein set forth or shown in the accompanying drawings is to be interpreted as illustrative and not in a limiting sense.

What is claimed is:

1. A dual-jacket assembly comprising:

an inner jacket comprising a pocket;

an outer jacket configured at least to be worn over the inner jacket and, when not in use, configured to be stowed in the pocket of the inner jacket; and a cable system that couples the outer jacket to the inner jacket, the cable system comprising a plurality of cables, each of the plurality of cables having a first end and a second end, wherein the first end of each of the plurality of cables is coupled to the inner jacket, and wherein the second end of each of the plurality of cables is coupled to the outer jacket, the plurality of cables configured to be used by a wearer to stow the outer jacket in the pocket of the inner jacket when not in use.

2. The dual-jacket assembly of claim 1, wherein the plurality of cables comprises at least a first cable and a second cable, the first ends of each of the first cable and the second cable being coupled to an inner-facing surface of the inner jacket, the second end of the first cable being coupled to an inner-facing surface of the outer jacket at a first location corresponding to an inferior margin of a first armhole of the outer jacket, and the second end of the second cable being coupled to the inner-facing surface of the outer jacket at a second location corresponding to an inferior margin of a second armhole of the outer jacket.

3. The dual-jacket assembly of claim 2, wherein the plurality of cables further comprises a third cable and a fourth cable, the first ends of each of the third cable and the fourth cable being coupled to an inner portion of the pocket of the inner jacket, the second end of the third cable being coupled to the inner-facing surface of the outer jacket at a third location corresponding generally to a horizontal midline of a back panel of the outer jacket, and the second end of the fourth cable being coupled to the inner-facing surface of the outer jacket at a fourth location corresponding generally to the horizontal midline of the back panel of the outer jacket.

4. The dual-jacket assembly of claim 3, wherein the plurality of cables further comprises a fifth cable having a first portion that couples to the first cable, a second portion that couples to the second cable, and a third portion that couples to the inner-facing surface of the outer jacket, wherein the first portion and the second portion connect to an end of the third portion opposite of an end of the third portion that is coupled to the outer jacket.

5. The dual-jacket assembly of claim 2, wherein the first cable and the second cable each comprise an intervening portion extending between the respective first ends and the second ends, the intervening portion of the first cable being passed through a first aperture on an inner liner layer of the inner jacket and the intervening portion of the second cable being passed through a second aperture on the inner liner layer of the inner jacket.

6. The dual-jacket assembly of claim 5, wherein each of the intervening portions comprises at least one stop portion preventing the first end of the first cable from passing through the first aperture and the first end of the second cable from passing through the second aperture.

7. The dual-jacket assembly of claim 5, further comprising a first trim piece surrounding the first aperture and a second trim piece surrounding the second aperture, wherein the first trim piece and the second trim piece reinforce the first and second apertures respectively.

8. The dual-jacket assembly of claim 1, wherein the outer jacket is formed from a lightweight material having a weight between 20 $g/m^2$ to 60 $g/m^2$.

9. The dual-jacket assembly of claim 8, wherein the outer jacket comprises a plurality of reinforcement cords located at predetermined locations on the outer jacket, the plurality of reinforcement cords adapted to provide structure to the outer jacket at the predetermined locations.

10. The dual-jacket assembly of claim 1, wherein the pocket is formed between an inner liner layer of the inner jacket and an exterior shell layer of the inner jacket.

11. The dual-jacket assembly of claim 10, wherein an opening to the pocket is horizontally oriented and at a location corresponding generally to a horizontal midline of a back panel of the inner jacket.

12. A dual-jacket assembly comprising:

an inner jacket comprising a pocket; and an outer jacket configured at least to be worn over the inner jacket and, when not being worn, configured to be stowed in the pocket of the inner jacket, wherein:

the outer jacket is coupled to the inner jacket by a cable system comprising at least a first cable and a second cable, and wherein a first end of the first cable and a first end of the second cable are removably coupled to an inner-facing surface of the inner jacket and a second end of the first cable and a second end of the second cable are removably coupled to an inner-facing surface of the outer jacket, and wherein the cable system is configured to be used by a wearer to stow the outer jacket in the pocket of the inner jacket when not in use.

13. The dual-jacket assembly of claim 12, wherein the inner jacket has at least one jacket pocket and wherein the outer jacket comprises at least one opening configured to align with the at least one jacket pocket on the inner jacket when the outer jacket is worn over the inner jacket.

14. The dual-jacket assembly of claim 12, wherein the outer jacket comprises a plurality of reinforcement cords located at predetermined locations on the outer jacket, the plurality of reinforcement cords adapted to provide structure to the outer jacket at the predetermined locations.

15. The dual-jacket assembly of claim 14, wherein at least a first reinforcement cord is at a first location generally corresponding to an inferior margin of a first armhole of the outer jacket and at least a second reinforcement cord is at a second location corresponding generally to an inferior margin of a second armhole of the outer jacket.

16. The dual-jacket assembly of claim 12, wherein the pocket is formed between an inner liner layer of the inner jacket and an exterior shell layer of the inner jacket and comprises a horizontally-oriented opening located at a horizontal midline of a back panel of the inner jacket.

17. A method of manufacturing a dual-jacket assembly, comprising:

providing an inner jacket comprising a pocket;

providing an outer jacket configured at least to be worn over the inner jacket, and, when not in use, configured to be stowed in the pocket of the inner jacket;

coupling the outer jacket to the inner jacket by a cable system, the cable system comprising a plurality of cables, each of the plurality of cables having a first end and a second end, wherein the first end of each of the plurality of cables is coupled to the inner jacket, and wherein the second end of each of the plurality of cables is coupled to the outer jacket, the plurality of cables configured to be used by a wearer to stow the outer jacket in the pocket of the inner jacket when not in use.

18. The method of manufacturing of claim 17, wherein the plurality of cables comprise at least a first cable, a second cable, a third cable, and a fourth cable wherein:

the first ends of each of the first cable and the second cable are coupled to an inner-facing surface of the inner jacket;

the second end of the first cable is coupled to an inner-facing surface of the outer jacket at a first location corresponding to an inferior margin of a first armhole of the outer jacket, the second end of the second cable is coupled to the inner-facing surface of the outer jacket at a second location corresponding to an inferior margin of a second armhole of the outer jacket;

the first ends of each of the third cable and the fourth cable are coupled to an inner portion of the pocket of the inner jacket;

the second end of the third cable is coupled to the inner-facing surface of the outer jacket at a third location corresponding generally to a horizontal midline of a back panel of the outer jacket; and the second end of the fourth cable is coupled to the inner-facing surface of the outer jacket at a fourth location corresponding generally to the horizontal midline of the back panel of the outer jacket.

19. The method of manufacturing of claim 18, wherein the outer jacket comprises a plurality of reinforcement cords located at predetermined locations on the outer jacket, the plurality of reinforcement cords adapted to provide structure to the outer jacket at the predetermined locations.

20. The method of manufacturing of claim 19, wherein the plurality of reinforcement cords comprise memory wire.

* * * * *